US008844310B2

(12) United States Patent
Chase et al.

(10) Patent No.: US 8,844,310 B2
(45) Date of Patent: Sep. 30, 2014

(54) HIGH CAPACITY ICE STORAGE IN A FREEZER COMPARTMENT

(75) Inventors: Kevin M. Chase, Saint Joseph, MI (US); Tony L. Koenigsknecht, Austin, TX (US); Douglas D. Leclear, Benton Harbor, MI (US); Kate E. Presnell, Kalamazoo, MI (US); Thomas D. Spicer, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 842 days.

(21) Appl. No.: 12/637,039

(22) Filed: Dec. 14, 2009

(65) Prior Publication Data

US 2011/0138842 A1 Jun. 16, 2011

(51) Int. Cl.

| | |
|---|---|
| ***F25C 5/18*** | (2006.01) |
| ***F25D 23/04*** | (2006.01) |
| ***F25C 1/24*** | (2006.01) |
| ***F25C 5/00*** | (2006.01) |

(52) U.S. Cl.

CPC ..... *F25C 5/187* (2013.01); *F25D 23/04* (2013.01); *F25C 1/24* (2013.01); *F25C 2400/10* (2013.01); *F25C 5/005* (2013.01)

USPC ..... 62/344

(58) Field of Classification Search

CPC ..... F25C 5/005; F25C 2400/10; F25C 1/24

USPC ..... 62/344

See application file for complete search history.

(56) References Cited

U.S. PATENT DOCUMENTS

| | | | | |
|---|---|---|---|---|
| 611,013 | A | | 9/1898 | Kneeland |
| 1,222,488 | A | | 4/1917 | Tallman |
| 2,449,132 | A | * | 9/1948 | Lucia ..... 62/137 |
| 2,791,887 | A | | 5/1957 | Hennig |
| 2,804,996 | A | | 9/1957 | Werner et al. |
| 2,866,322 | A | | 12/1958 | Muffly |
| 2,967,407 | A | | 1/1961 | Melikian |
| 3,062,413 | A | | 11/1962 | Adams et al. |
| 3,146,601 | A | | 9/1964 | Gould |
| 3,264,844 | A | | 8/1966 | Kesling |
| 3,514,964 | A | | 6/1970 | Dodge, III et al. |
| 3,621,668 | A | | 11/1971 | Swerbinsky |
| 3,744,270 | A | | 7/1973 | Wilcox |
| 3,744,679 | A | | 7/1973 | Nitschneider et al. |
| 3,892,337 | A | | 7/1975 | Neumann |
| 4,055,280 | A | | 10/1977 | Kohl et al. |
| 4,084,725 | A | | 4/1978 | Buchser |
| 4,124,145 | A | | 11/1978 | Spinner et al. |
| 4,168,805 | A | | 9/1979 | Taylor |
| 4,285,212 | A | | 8/1981 | Prada |
| 4,541,252 | A | | 9/1985 | Reimer |

(Continued)

*Primary Examiner* — Allen Flanigan
*Assistant Examiner* — Filip Zec

(57) ABSTRACT

A refrigerator including a cabinet having a cabinet door pivotally connected thereto. A primary ice bin is disposed on one of the cabinet and the cabinet door and includes a primary gate operable between a closed position and an open position. A secondary ice bin is disposed on the other of the cabinet and the cabinet door. The secondary ice bin includes a secondary gate operable between a closed position and an open position. The secondary gate operably engages with the primary gate to form an ice overflow route when the primary gate and the secondary gate are in the open position. An ice maker is disposed inside the cabinet and adapted to dispense ice into the primary ice storage bin.

20 Claims, 30 Drawing Sheets

(56) References Cited

U.S. PATENT DOCUMENTS

| | | | | | |
|---|---|---|---|---|---|
| 4,641,763 | A | | 2/1987 | Landers et al. | |
| 4,676,371 | A | | 6/1987 | Byrne | |
| 4,771,609 | A | | 9/1988 | Funabashi | |
| 4,836,401 | A | | 6/1989 | Ingemann | |
| 4,966,008 | A | * | 10/1990 | Yoshida et al. | 62/137 |
| 4,997,109 | A | | 3/1991 | Carper | |
| D324,869 | S | | 3/1992 | Carper | |
| 5,240,150 | A | | 8/1993 | Palmon | |
| 5,253,480 | A | * | 10/1993 | Sakai | 62/78 |
| 5,299,427 | A | | 4/1994 | Miller et al. | |
| 5,323,917 | A | | 6/1994 | Johnson et al. | |
| 5,581,982 | A | | 12/1996 | Schroeder et al. | |
| 6,148,624 | A | | 11/2000 | Bishop et al. | |
| D447,493 | S | | 9/2001 | Shelley et al. | |
| 6,286,324 | B1 | | 9/2001 | Pastryk et al. | |
| 6,314,745 | B1 | | 11/2001 | Janke et al. | |
| 6,351,958 | B1 | | 3/2002 | Pastryk et al. | |
| 6,414,301 | B1 | | 7/2002 | Borg, Jr. et al. | |
| 6,425,259 | B2 | | 7/2002 | Nelson et al. | |
| 6,438,976 | B2 | | 8/2002 | Shapiro et al. | |
| 6,442,954 | B1 | | 9/2002 | Shapiro et al. | |
| 6,708,509 | B1 | | 3/2004 | Senner | |
| 6,758,047 | B1 | | 7/2004 | Giles | |
| 6,827,529 | B1 | * | 12/2004 | Berge et al. | 406/28 |
| 7,013,657 | B2 | | 3/2006 | Hwang et al. | |
| 7,017,363 | B2 | | 3/2006 | Lee et al. | |
| D522,542 | S | | 6/2006 | Czach et al. | |
| 7,216,491 | B2 | | 5/2007 | Cole et al. | |
| 7,266,957 | B2 | | 9/2007 | Anderson et al. | |
| 7,360,377 | B2 | * | 4/2008 | Park et al. | 62/320 |
| 7,373,789 | B2 | | 5/2008 | Oh et al. | |
| 8,091,374 | B2 | * | 1/2012 | Chang | 62/137 |
| 2005/0044874 | A1 | * | 3/2005 | Lee et al. | 62/344 |
| 2006/0059939 | A1 | | 3/2006 | An et al. | |
| 2006/0248912 | A1 | | 11/2006 | Park et al. | |
| 2007/0119193 | A1 | | 5/2007 | Davis et al. | |
| 2007/0204644 | A1 | | 9/2007 | Braun et al. | |
| 2008/0053112 | A1 | | 3/2008 | Higashitani et al. | |
| 2008/0127670 | A1 | | 6/2008 | Tikhonov et al. | |
| 2010/0037631 | A1 | * | 2/2010 | Choi et al. | 62/66 |

* cited by examiner

HIGH CAPACITY ICE STORAGE IN A FREEZER COMPARTMENT

BACKGROUND OF THE PRESENT INVENTION

The present invention generally relates to ice storage in the freezer compartment, and more specifically, to high capacity ice storage systems for use in freezer cabinets.

SUMMARY OF THE INVENTION

In one aspect of the present invention, a refrigerator including a cabinet having a cabinet door pivotally connected thereto. A primary ice bin is disposed on one of the cabinet and the cabinet door and includes a primary gate operable between a closed position and an open position. A secondary ice bin is disposed on the other of the cabinet and the cabinet door. The secondary ice bin includes a secondary gate operable between a closed position and an open position. The secondary gate operably engages with the primary gate to form an ice overflow route when the primary gate and the secondary gate are in the open position. An ice maker is disposed inside the cabinet and adapted to dispense ice into the primary ice storage bin.

In another aspect of the present invention, a refrigerator including a cabinet having a cabinet door pivotally connected thereto. An ice maker is disposed inside the cabinet. A primary ice bin is disposed on one of the cabinet and the cabinet door and includes a ramp engageable with the primary ice bin and operable between a raised position and a diverting position. A secondary ice bin is disposed on the other of the cabinet and the cabinet door. The primary ice bin receives ice from the ice maker when the ramp is in the raised position. The ramp diverts ice from the ice maker to the secondary ice bin when the ramp is in the diverting position.

In yet another aspect of the present invention, a refrigerator including a cabinet having a cabinet door pivotally connected thereto. An ice maker is disposed inside the cabinet. A primary ice bin is adapted to receive ice from the ice maker. The primary ice bin is disposed on one of the cabinet and the cabinet door and operable between a receiving condition and an overflow condition. A secondary ice bin is disposed on the other of the cabinet and the cabinet door. An overflow gate is proximate the primary ice bin and operable between a closed position that corresponds to the receiving condition of the primary ice bin and an open position that corresponds to the overflow condition of the primary ice bin. Ice that is dispensed into the primary ice bin from the ice maker flows over the overflow gate from the primary ice bin to the secondary ice bin when the primary ice bin is in the overflow condition and the overflow gate is in the open position.

These and other features, advantages, and objects of the present invention will be further understood and appreciated by those skilled in the art upon studying the following specification, claims, and appended drawings.

DETAILED DESCRIPTION OF EMBODIMENTS

Figure 1A:
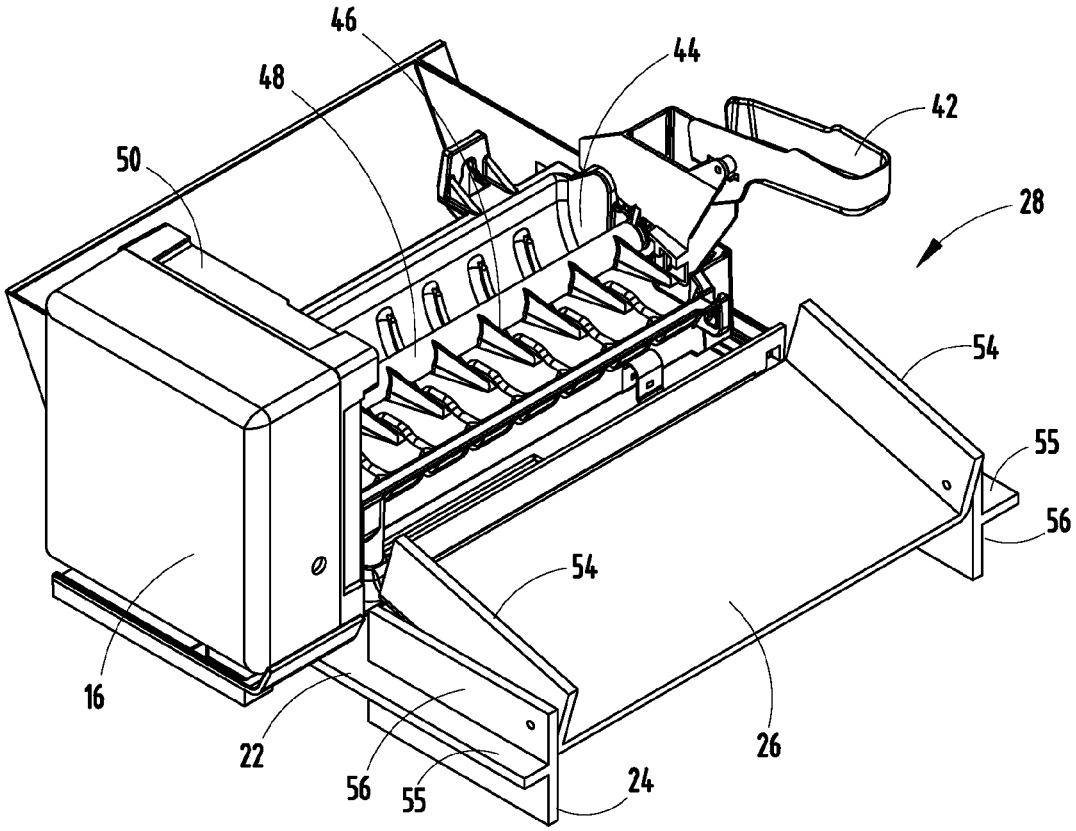
FIG. 1A is a top perspective view of one embodiment of a routing device and ice maker of the present invention.
Figure 1B:
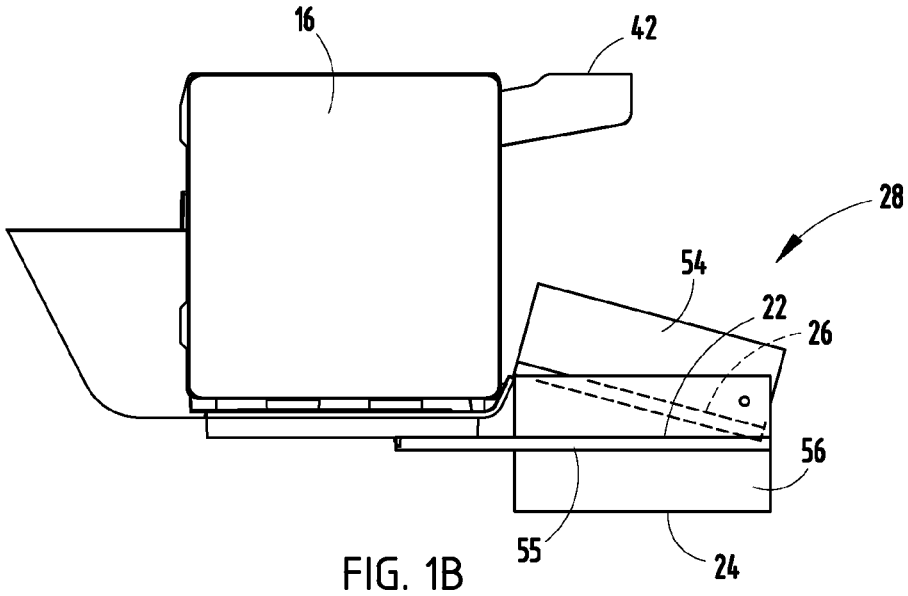
FIG. 1B is a side elevational view of the routing device and ice maker of FIG. 1A.
Figure 2A:
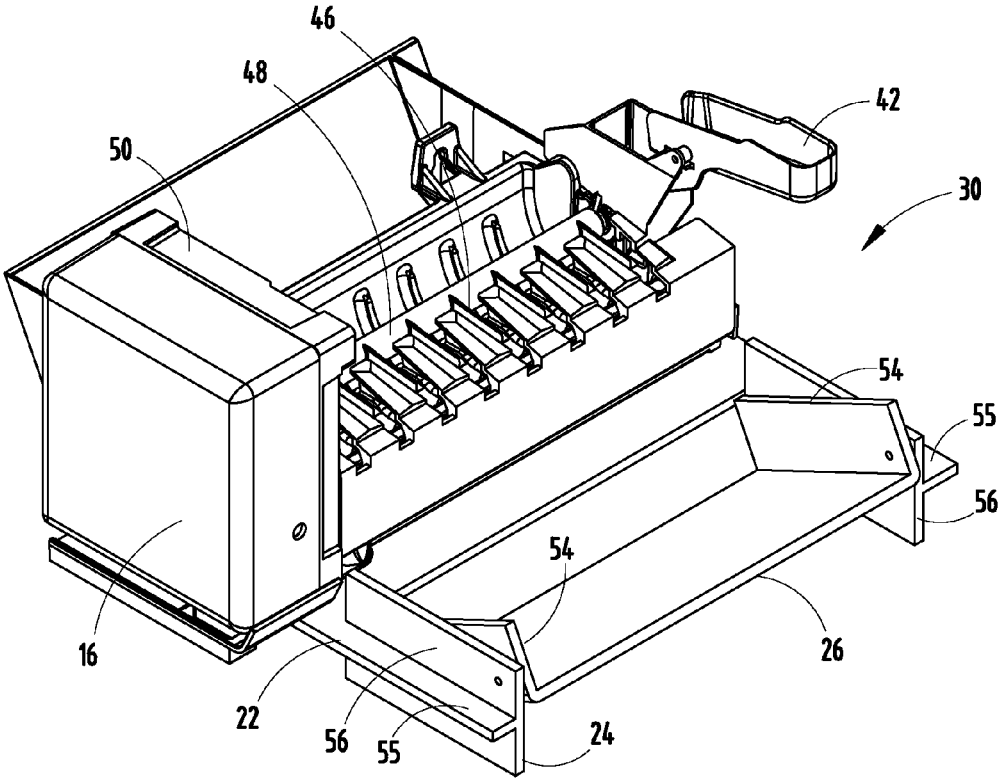
FIG. 2A is a top perspective view of the routing device and ice maker of FIG. 1A with the ramp in a downward position.
Figure 2B:
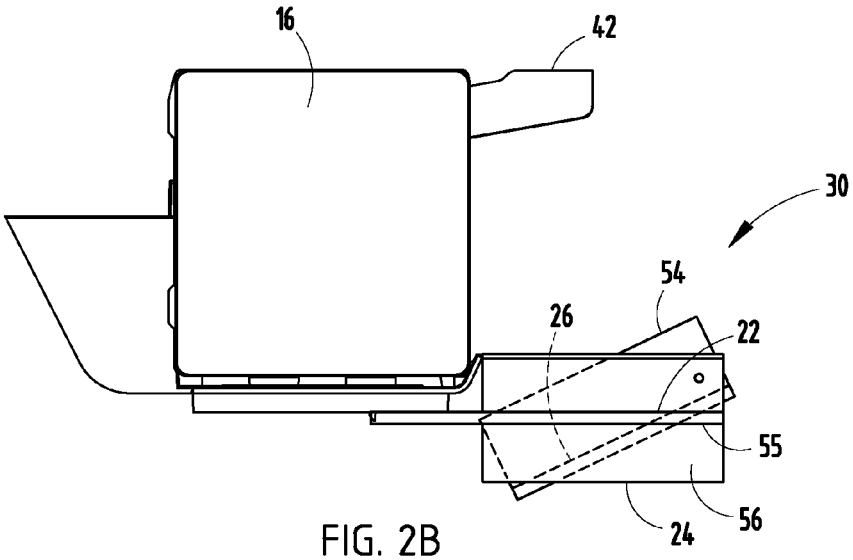
FIG. 2B is a side elevational view of the routing device and ice maker of FIG. 2A.

For purposes of description herein the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1-5B, the reference numeral 10 generally designates an appliance having a cabinet 12 with a cabinet door 14 and an ice maker 16. A primary ice bin 18 is disposed in the cabinet door 14 of the appliance 10. A secondary ice bin 20 is disposed in the cabinet 12 of the appliance 10. A routing device 22 is disposed inside the cabinet 12. The routing device 22 includes a stationary base 24 that supports an adjustable ramp 26. The ramp 26 is operable between a first position 28 that directs ice 29 to the primary ice bin 18 and a second position 30 that directs ice 29 to the secondary ice bin 20.

Referring again to FIGS. 1-5B, the ice maker 16 is mounted to an interior wall 40 of the cabinet 12. The ice maker 16 has a water receiving funnel 42 that relays water down to a collection trough 44. The collection trough 44 includes a plurality of fingers 46 that remove the water after the water has frozen into ice 29 in the collection trough 44. The fingers 46 are connected to a shaft 48 that engages a motor 50. The motor 50 activates after a predetermined time has passed (the time needed to freeze water). The routing device 22 is positioned so that the ramp 26 can be adjusted to dispense ice 29 into the primary ice bin 18 in the cabinet door 14 or into the secondary ice bin 20 in the cabinet 12. The adjustable ramp 26 includes side flanges 54 that assist in guiding the ice 29 into the appropriate bin 18, 20, thereby minimizing the likelihood that ice 29 will fall off a side of the ramp 26 into the cabinet 12.

Figure 3:
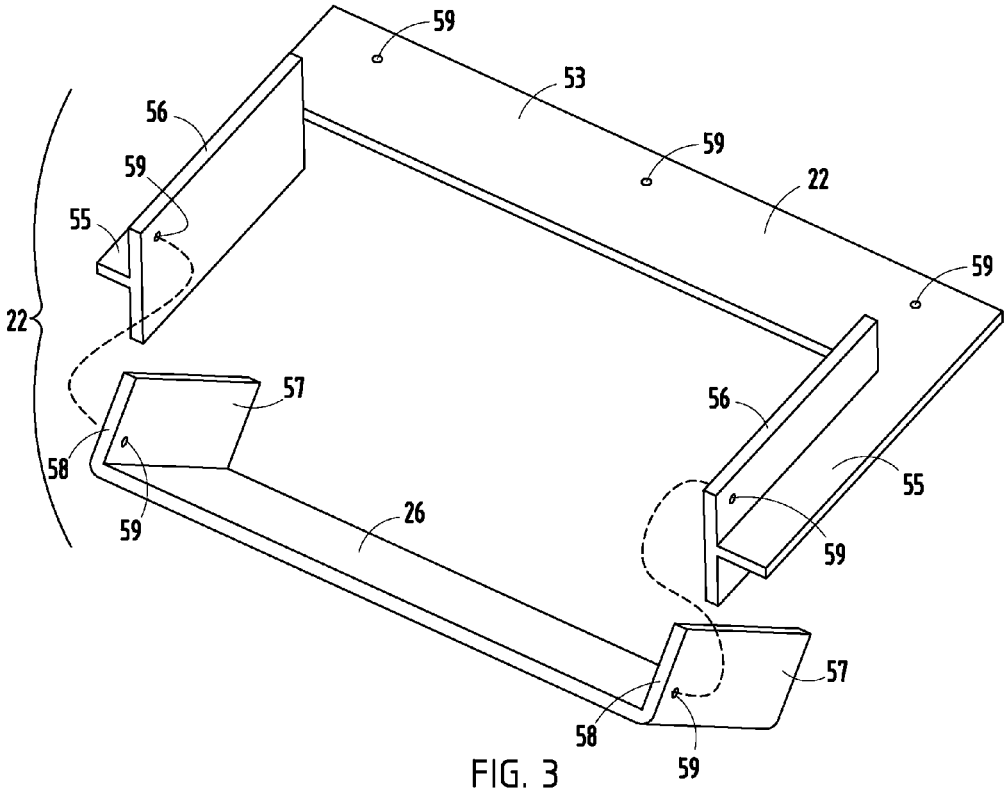
FIG. 3 is a top perspective exploded view of the routing device of FIG. 1A.
Figure 4:
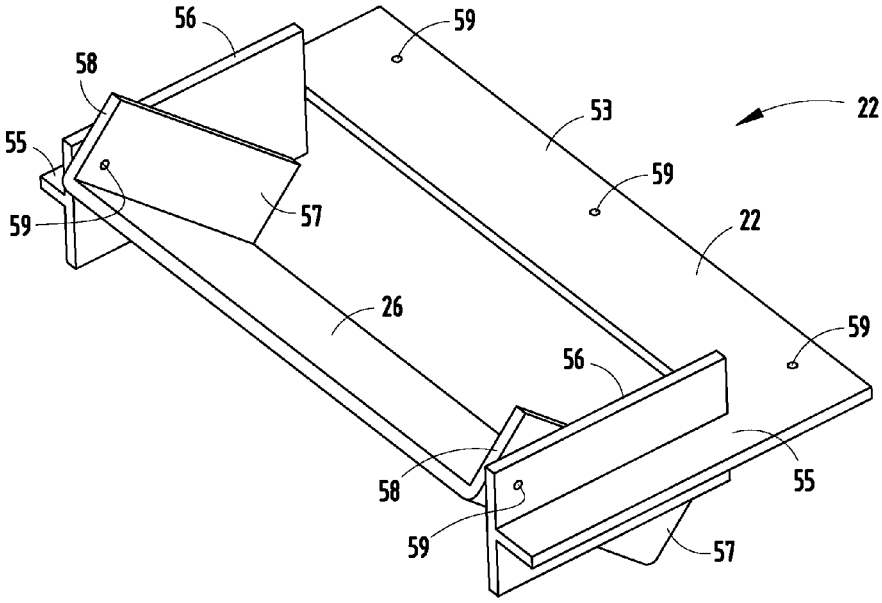
FIG. 4 is a top perspective view of the routing device of FIG. 3.
Figure 5A:
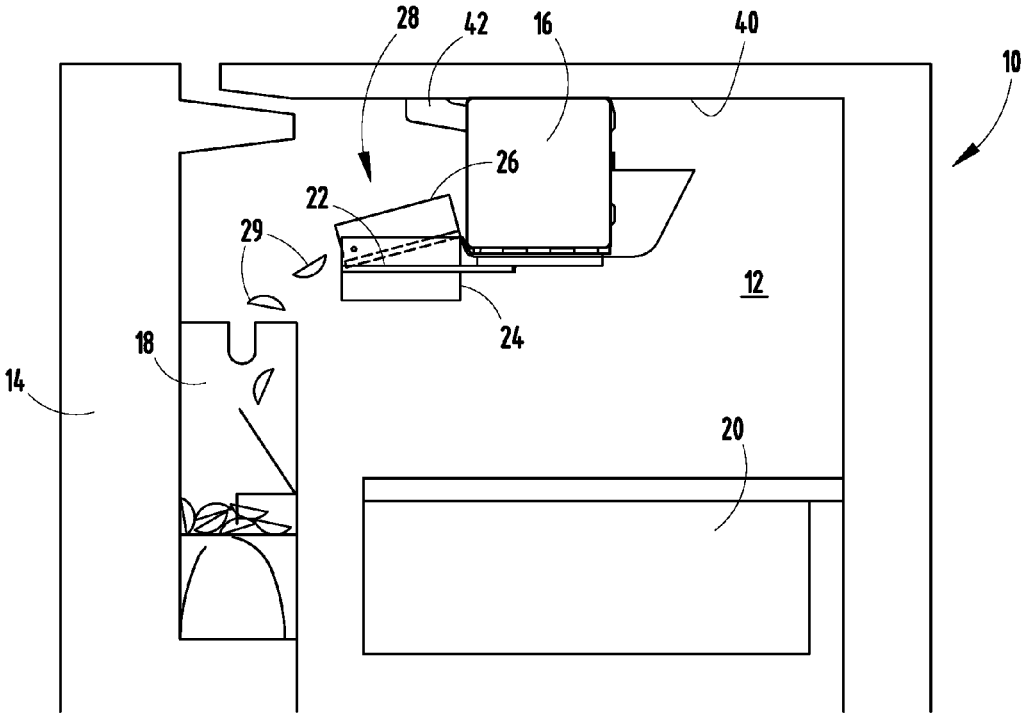
FIG. 5A is a side elevational view of the routing device routing ice into an in-door ice bucket.
Figure 5B:
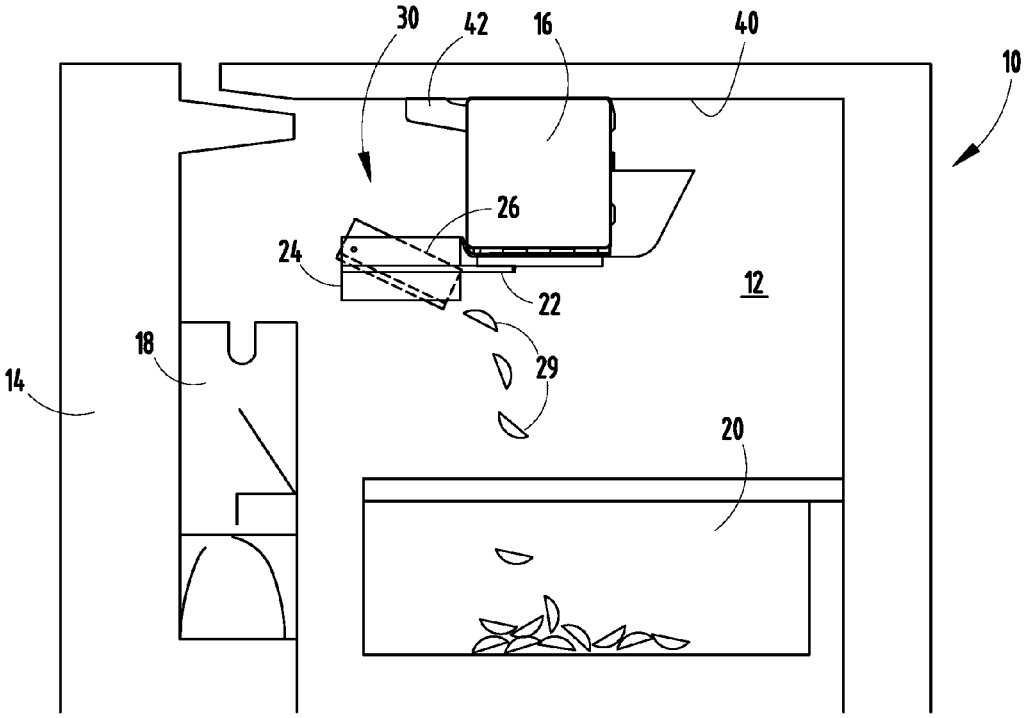
FIG. 5B is a side elevational view of the routing device routing ice into a secondary bin.
Figure 6A:
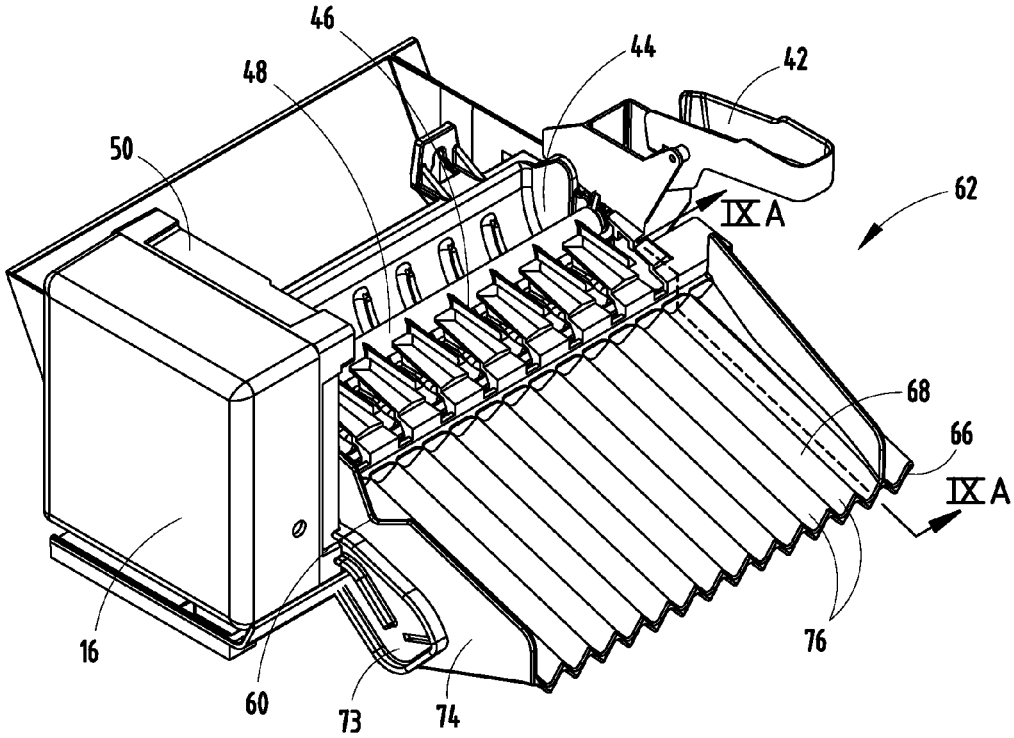
FIG. 6A is a top perspective view of another embodiment of a routing device and ice maker of the present invention.
Figure 6B:
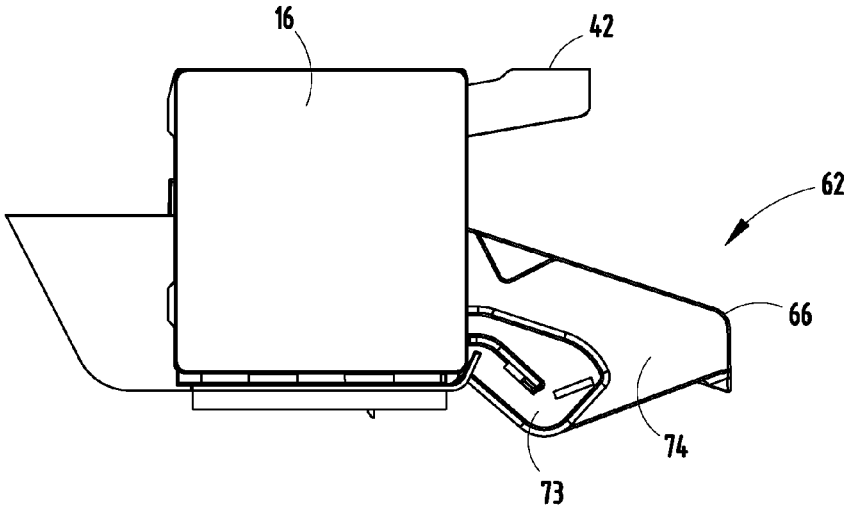
FIG. 6B is a side elevational view of the routing device and ice maker of FIG. 6A.
Figure 7A:
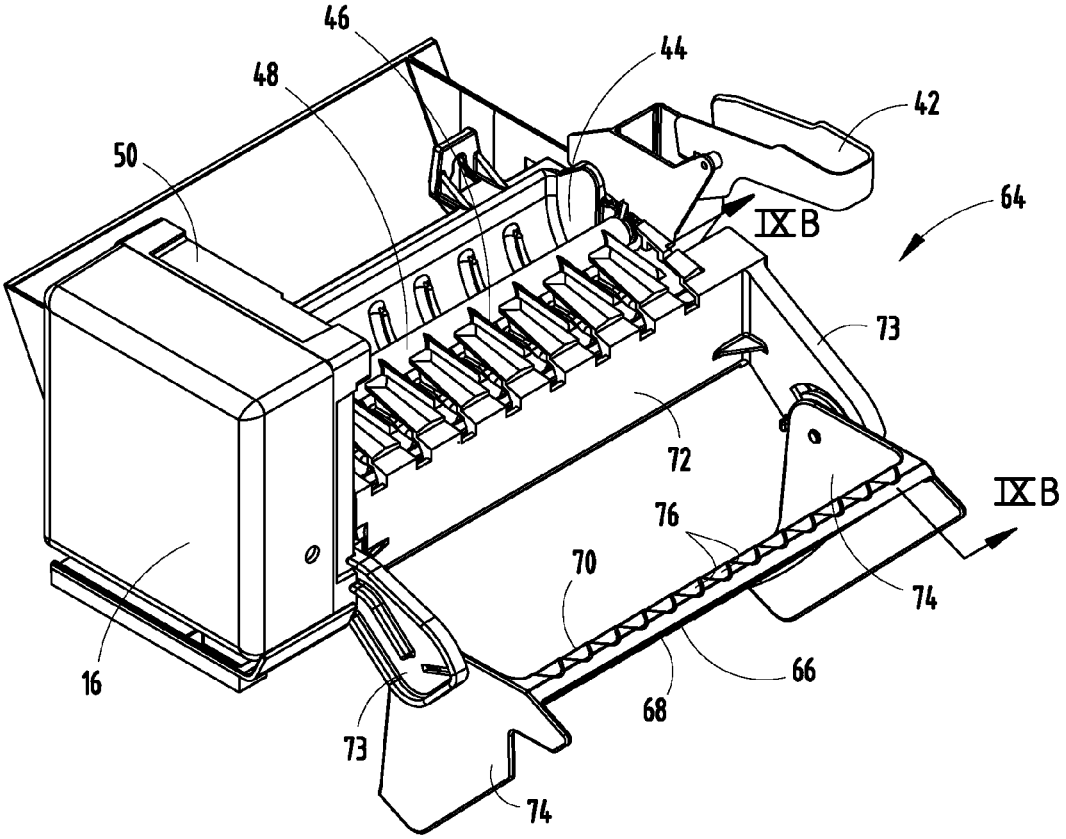
FIG. 7A is a top perspective view of the routing device and ice maker of FIG. 6A in a lowered position.
Figure 7B:
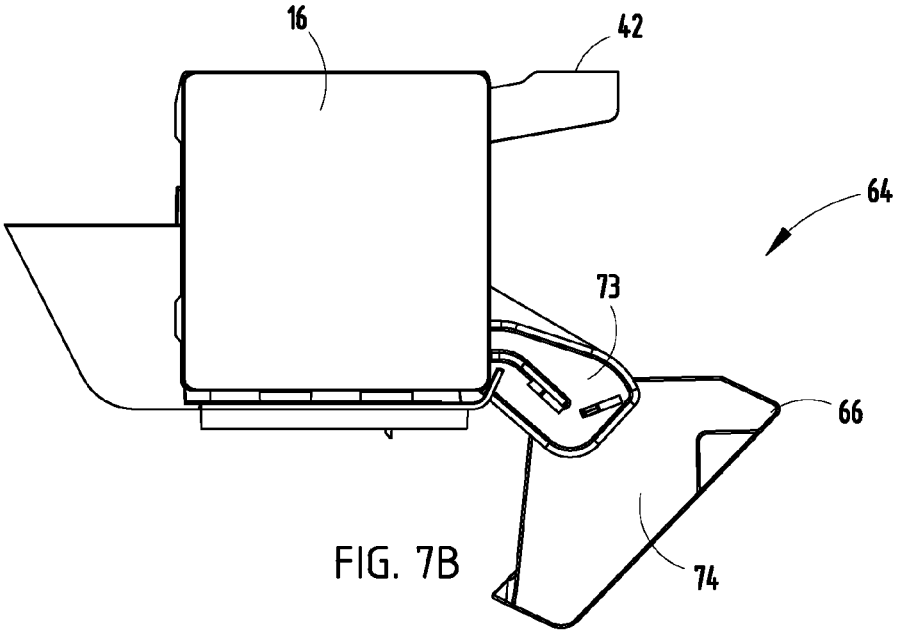
FIG. 7B is a side elevational view of the routing device and ice maker of FIG. 7A.

As shown in FIGS. 3 and 4, the stationary base 24 of the routing device 22 includes a body portion 53 that extends between side supports 55. The side supports 55 include an abutting flange 56 that extends both above and below the planar extent of the body portion 53. The ramp 26 includes a proximal end 57 and a distal end 58. Mechanical fastener apertures 59 are disposed in the body portion 53 and also through the abutting flanges 56. The distal end 58 of the ramp 26 is pivotally connected to the abutting flanges 56 which allows for the ramp to move between the first raised position 28 (FIGS. 1A and 1B) that directs ice 29 to the primary ice bin 18 and the second position 30 (FIGS. 2A and 2B) that directs ice 29 to the secondary ice bin 20. It is also contemplated that the ramp 26 could be connected to the stationary base 24 at the proximal end 57 or an intermediate position along the side supports 55. The body portion 53 of the routing device 22 is connected to the ice maker 16 on an underside thereof by mechanical fasteners. It is contemplated that the routing device 22 may be constructed from any of a variety of materials including plastic, aluminum, etc. or combinations thereof.

Referring again to FIGS. 5A and 5B, when the routing device 22 is in the first position, ice 29 from the ice maker 16 falls onto the proximal end 57 of the adjustable ramp 26 and cascades downward off of the distal end 58 of the ramp 26 and into the primary ice bin 18. When the routing device 22 is in the second position 30, ice 29 falls from the ice maker 16 onto the ramp 26 and cascades toward the proximal end 57 of the ramp 26 into the secondary ice bin 20. The ice 29 descends in one direction toward the distal end 57 of the ramp 26 when the routing device 22 is in the first position 28 and descends in the opposite direction toward the proximal end 58 of the ramp 26 when the routing device 22 is in the second position 30.

Referring now to the illustrated embodiment shown in FIGS. 6-10B, the ice maker 16 includes a routing device 60 that is operable between a first position 62 that relays ice 29 to the primary ice bin 18 and a second position 64 that relays ice 29 to the secondary ice bin 20. The routing device 60 has an adjustable ramp 66 that includes a first side 68 that routes ice 29 to the primary ice bin 18 disposed in the cabinet door 14, and a second side 70 that routes ice 29 to the secondary ice bin 20 disposed in the cabinet 12 below the ice maker 16. The routing device 60 includes a stationary base 72 with side supports 73 that are pivotally connected at pivot points 71 to side flanges 74 disposed on the ramp 66. The side flanges 74 prevent ice 29 from spilling over sides 68, 70 of the ramp 66. In addition, the longitudinal extent of the ramp 66 is accordion-shaped to form a plurality of channels 76 that assist to direct ice 29 down into the desired bin 18, 20 and minimize sideways travel across the adjustable ramp 66.

Figure 8:
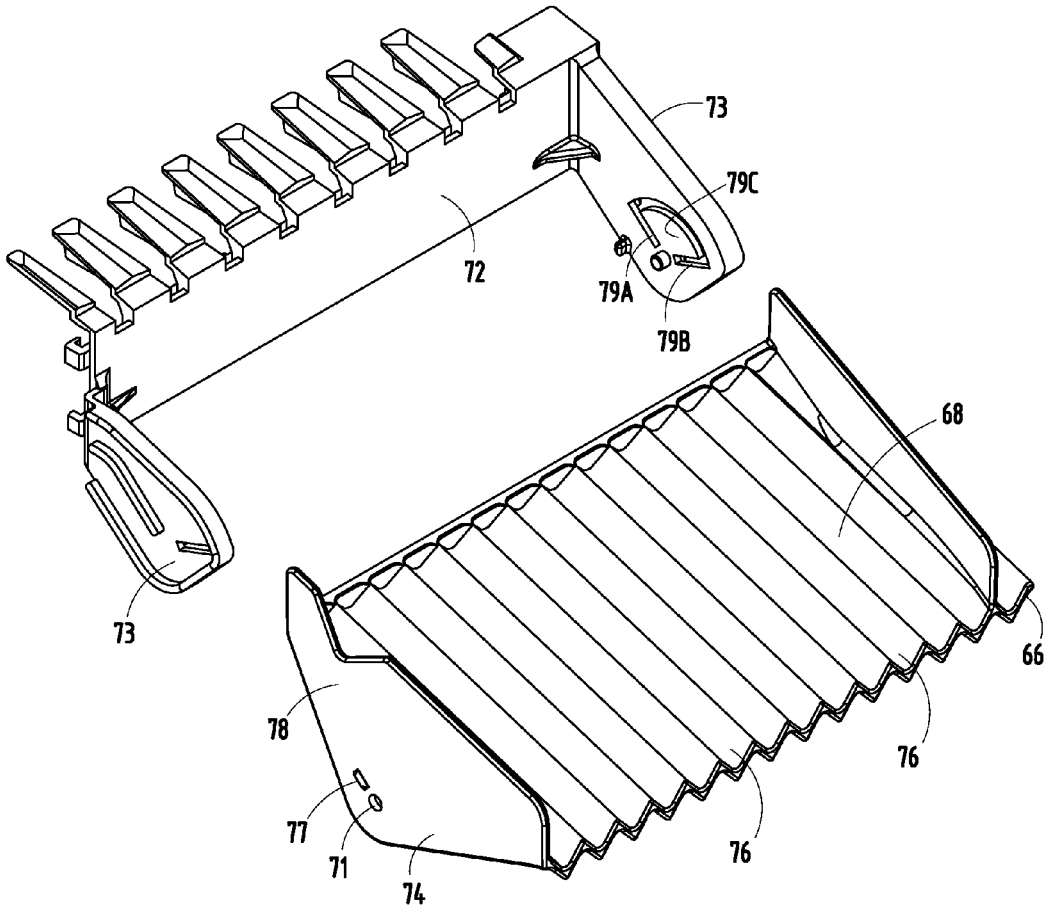
FIG. 8 is a top perspective exploded view of the routing device of FIG. 6A.
Figure 9A:
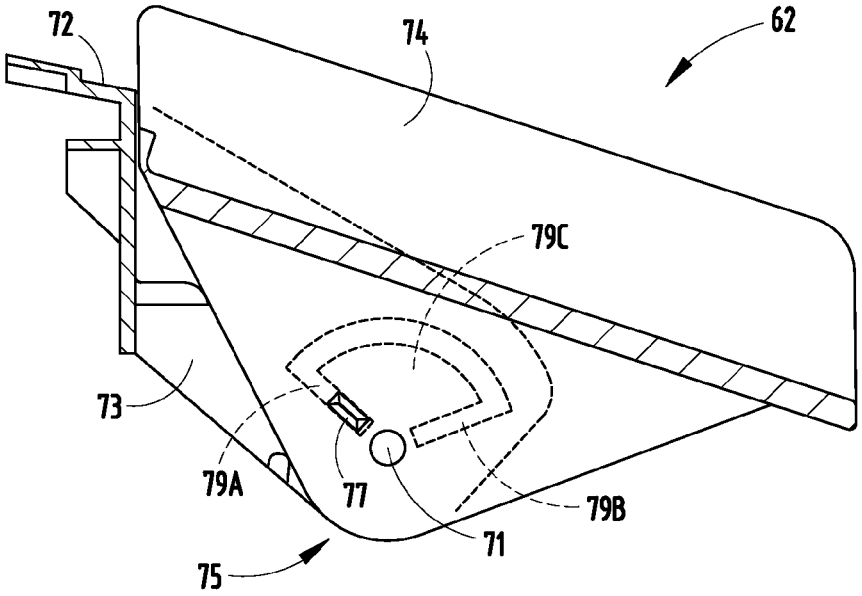
FIG. 9A is a side cross-sectional view taken at line IXA-IXA of FIG. 6A.
Figure 9B:
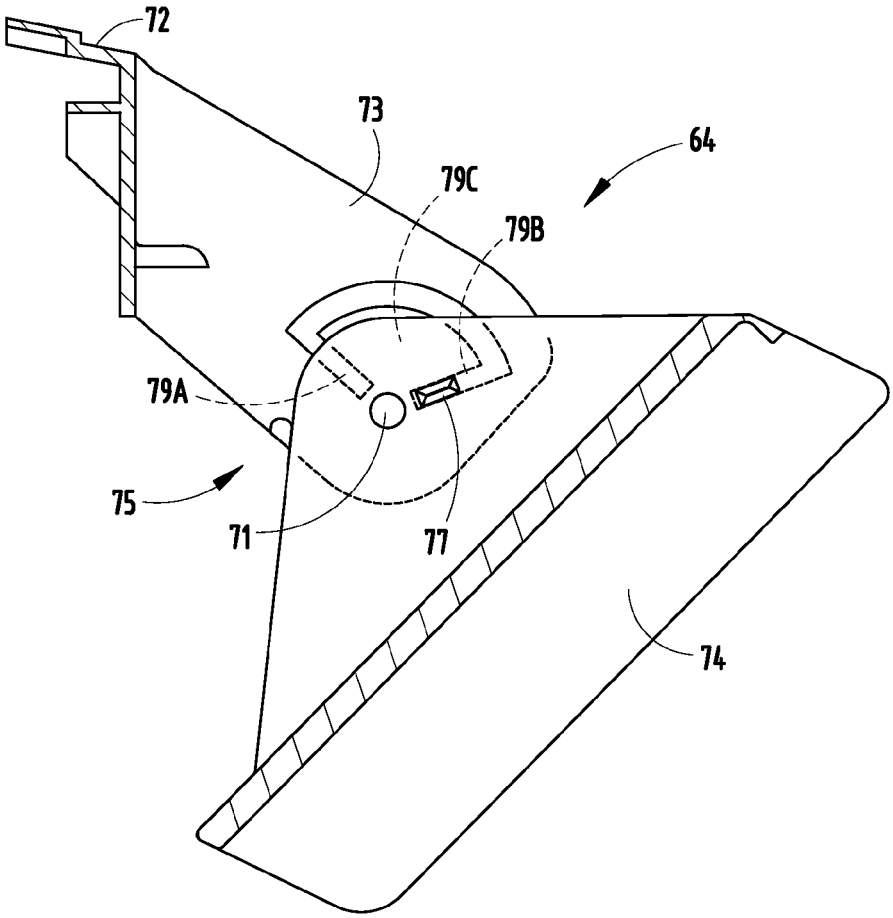
FIG. 9B is a side cross-sectional view taken at line IXB-IXB of FIG. 6B.
Figure 10A:
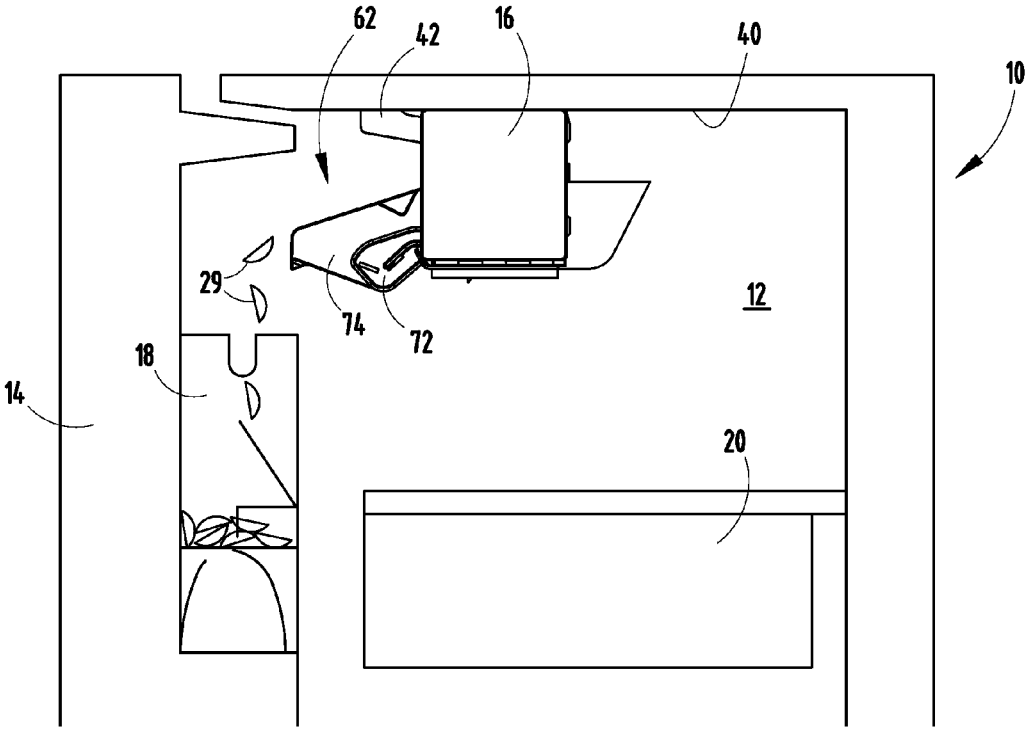
FIG. 10A is a side elevational view of the routing device routing ice into an in-door ice bucket.
Figure 10B:
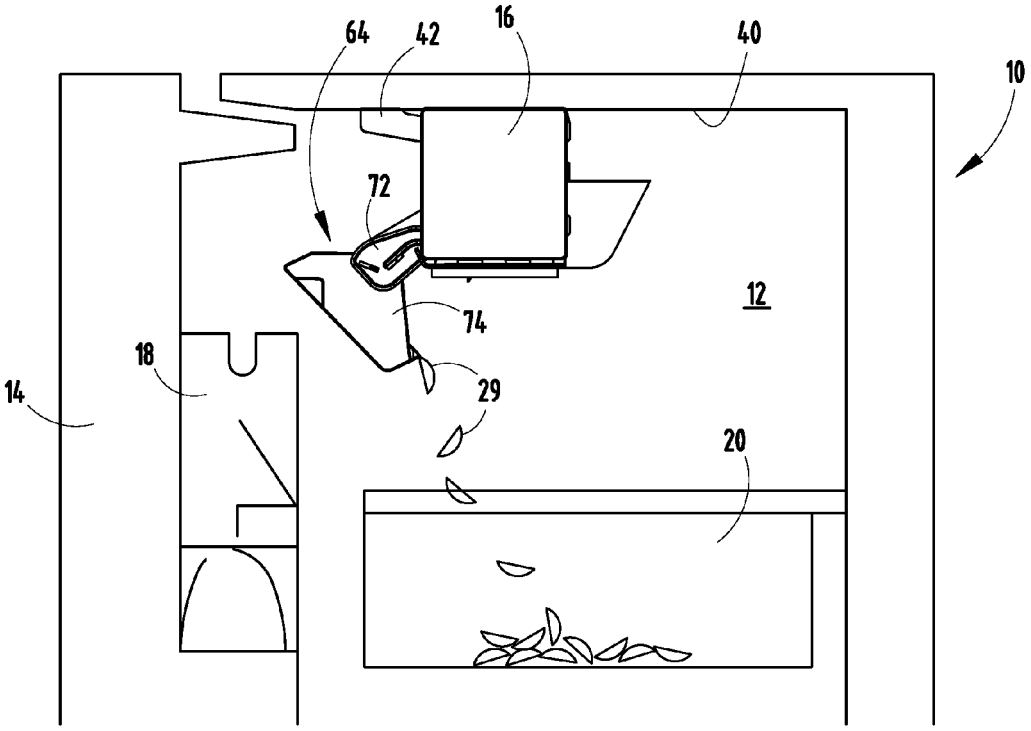
FIG. 10B is a side elevational view of the routing device routing ice into a secondary bin.

As shown in the embodiment illustrated in FIGS. 8, 9A, and 9B, the side supports 73 include an abutment system 75 that interacts with a stop 77 disposed on the outside wall 78 of each side flange 74. The abutment system includes receiving slots 79A and 79B that elastically receive the stop 77. When the stop 77 engages the receiving slot 79A, the routing device 60 is in the first position 62 and the ramp 66 is oriented to direct ice 29 from the ice maker 16 to the primary ice bin 18. When the stop 77 engages the receiving slot 79B, the routing device 60 is in the second position 64 and the ramp 66 is oriented to relay ice 29 to the secondary ice bin 20. The receiving slots 79A, 79B are separated by a flexible tab 79C that flexes slightly outwardly to accommodate the stop 77 when the ramp 66 is moving from the first position 62 to the second position 64 and from the second position 64 to the first position 62. It is contemplated that the routing device 60 may be constructed from any of a variety of materials including plastic, aluminum, etc. or combinations thereof. Other routing device constructions may also be used, such as those described in "ROTATING RAMP AND METHOD FOR FILLING AN ICE BIN," U.S. Patent Application Publication No. 2011/0138821, published on Jun. 16, 2011, the entire disclosure of which is hereby incorporated herein by reference.

Figure 11A:
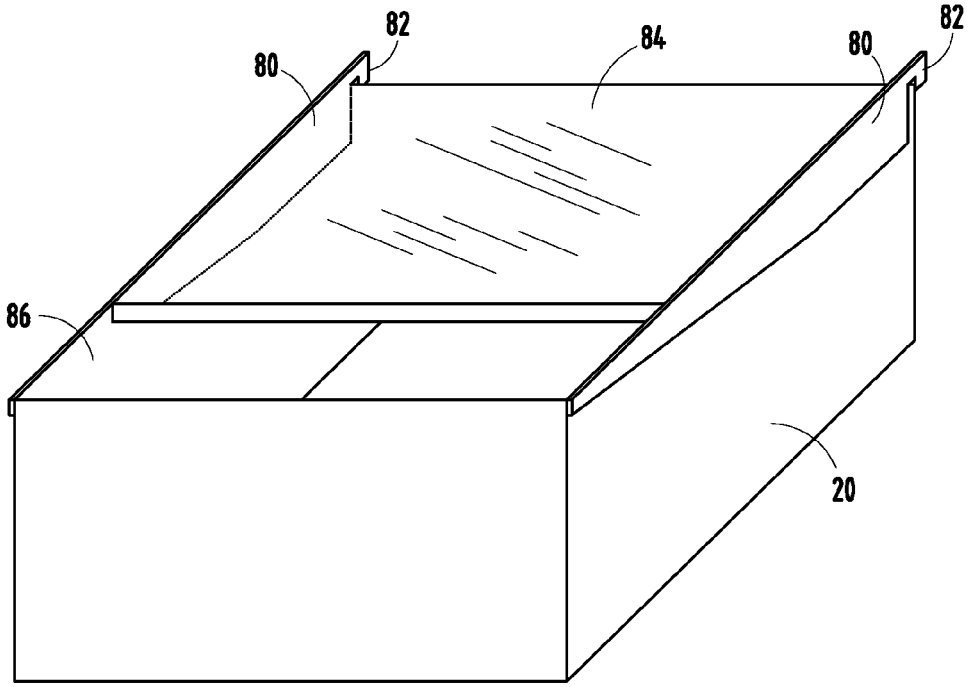
FIG. 11A is a top perspective view of one embodiment of an enlarged secondary bin of the present invention.

Referring now to FIG. 11A, the secondary ice bin 20 is a high capacity ice storage bin system for use in a side-by-side refrigerator. The system is able to secure over 16 pounds of ice 29, and is adapted to receive ice 29 from the ice maker 16, disperse ice 29 within the secondary ice bin 20 to ensure uniform distribution, and detect ice 29 levels to prevent ice 29 overflow. The high capacity ice storage bin 20 is designed for use with a primary ice bin 18 (in-door ice storage bin).

Referring again to FIG. 11A, the secondary ice bin 20 is a high capacity ice storage bin, or mega bin, serves as a secondary backup bin and is formed from a clear plastic. The mega bin 20 is mounted to modified freezer shelf supports 80. The shelf supports 80 include hooks 82 to latch on to a rear shelf ladder, thereby allowing the secondary ice bin 20 to be positioned within the upper levels of the freezer cabinet 12. Approximately two-thirds of the top of the secondary ice bin 20 is covered by a clear plastic shelf 84 that serves to protect frozen goods and cover stored ice 29. Ice 29 enters the secondary ice bin 20 from an open portion 86 of the secondary ice bin 20. The secondary ice bin 20 is capable of holding at least 16 pounds of ice 29 and can store frozen goods when not used for ice 29 storage. A door (not shown) may be present to cover the open portion 86 of the secondary ice bin 20 to cover the ice 29.

Figure 11B:
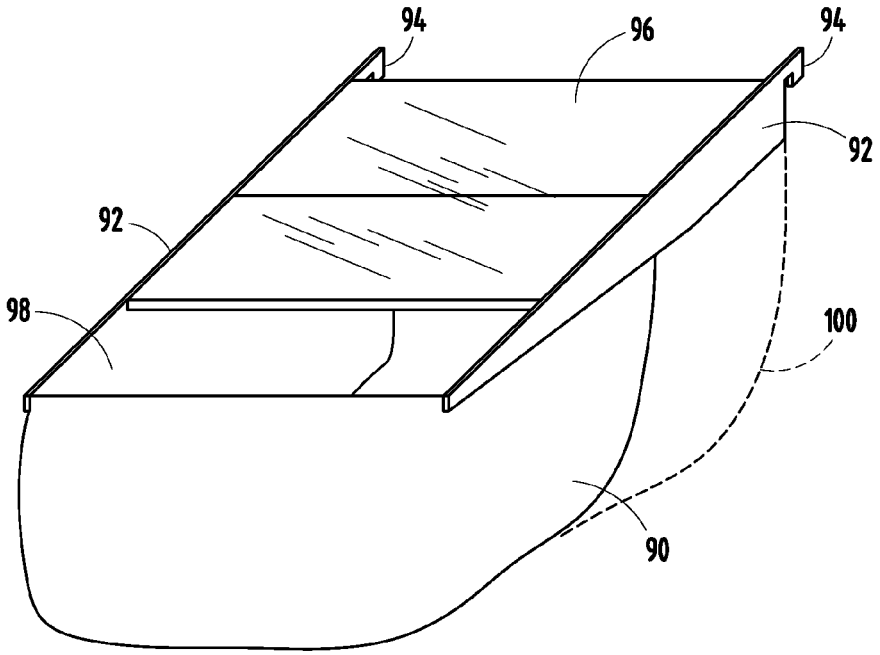
FIG. 11B is a top perspective view of the enlarged secondary bin of FIG. 11A with a storage bag.
Figure 11C:
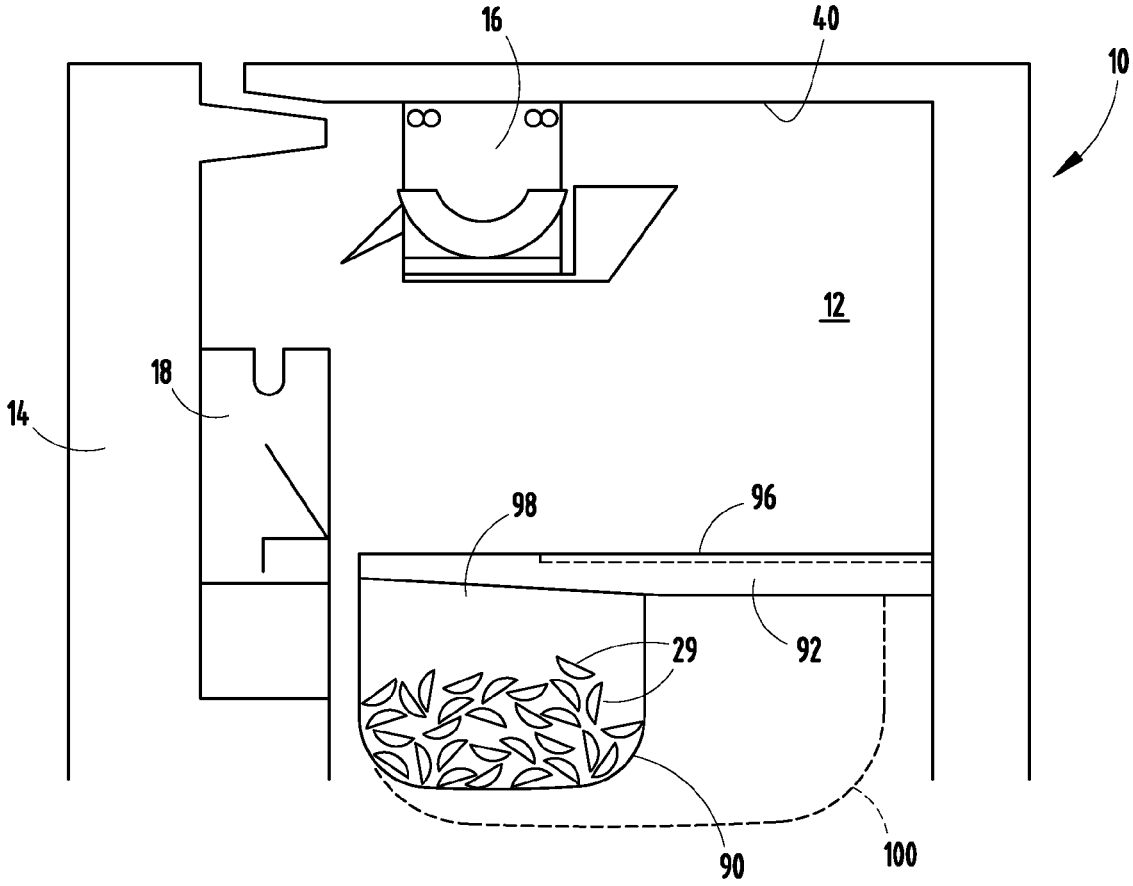
FIG. 11C is a side elevational view of the enlarged secondary bin of FIG. 11B with the storage bag installed in a freezer cabinet.

In another embodiment, as shown in FIGS. 11B and 11C, ice 29 is stored in a storage bag 90 mounted to a modified freezer shelf support 92. The shelf supports 92 include hooks 94 that latch on to the rear shelf ladder, which positions the storage bag 90 within the upper levels of the freezer cabinet 12. Two-thirds of the top of the storage bag 90 are covered by a clear plastic that serves as a shelf 96 for frozen goods and a cover for stored ice 29. Ice 29 enters the storage bag 90 from an open portion 98 and the storage bag 90 is capable of holding at least 16 pounds of ice 29. In addition, the storage bag 90 is a consumable that is available in different sizes for variable volume ice storage 100. Accordingly, the storage bag 90 may be removed and another storage bag 90 of the same or a different size may be installed in its place.

Figure 12A:
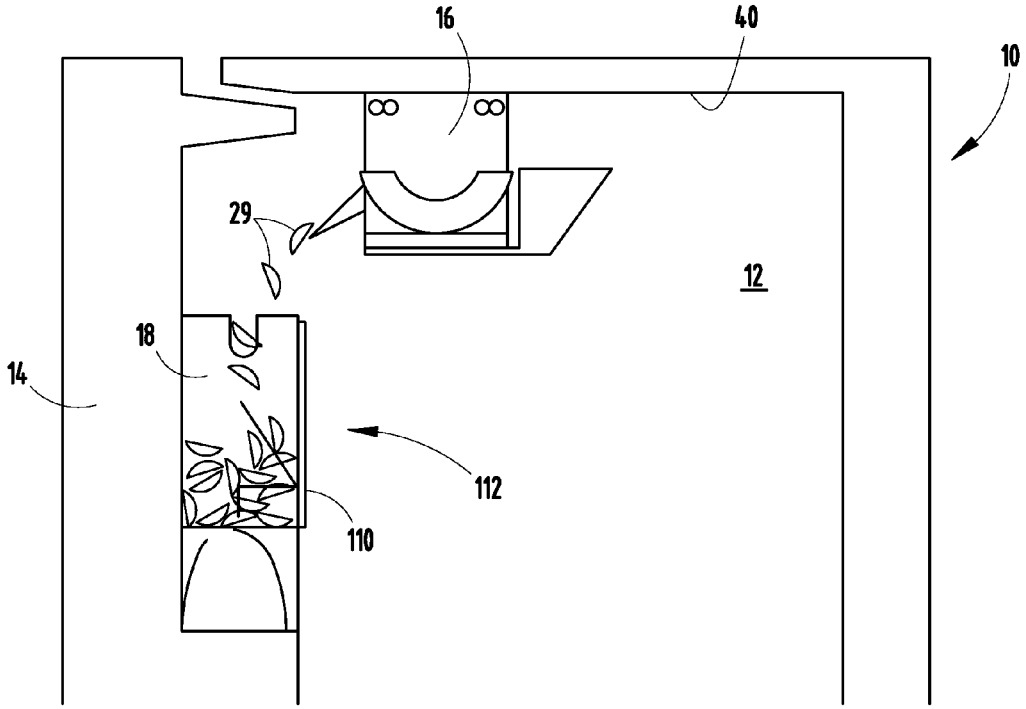
FIG. 12A is a side elevational view of one embodiment of an expandable primary ice bin in the retracted position.
Figure 12B:
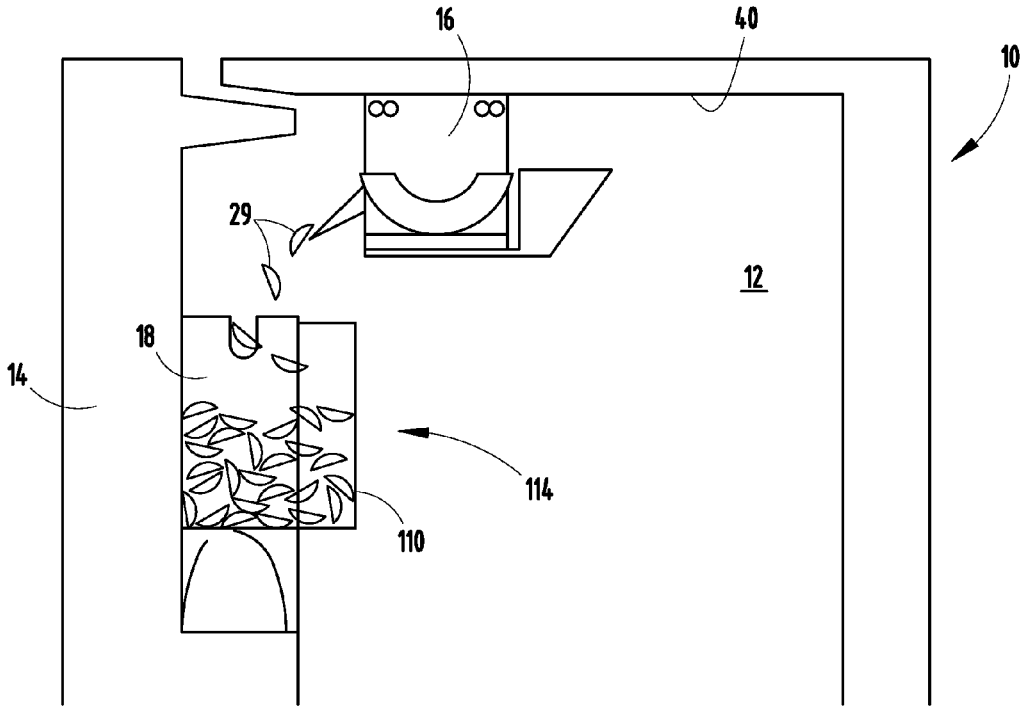
FIG. 12B is a side elevational view of the expandable primary ice bin of FIG. 12A in the expanded position.
Figure 13A:
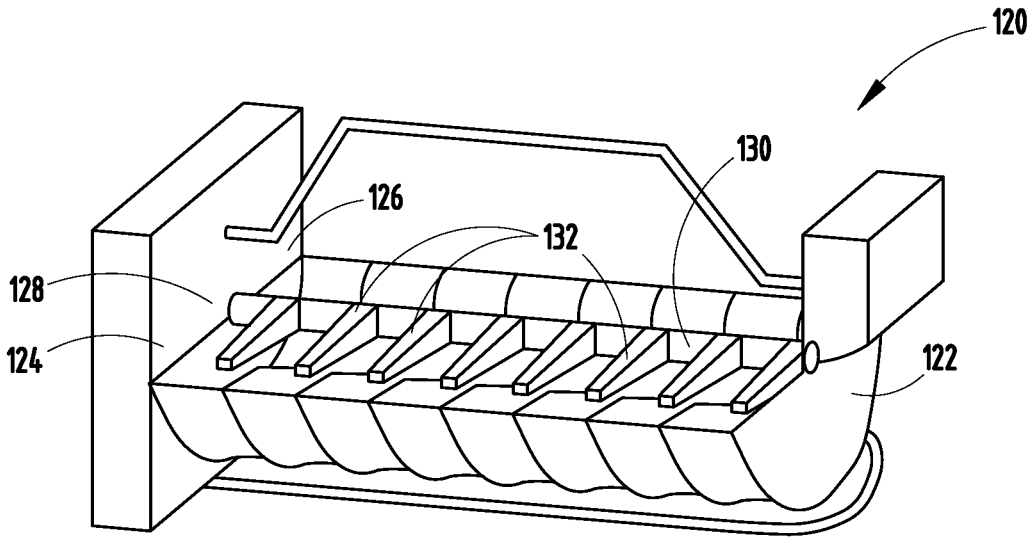
FIG. 13A is a top perspective view of one embodiment of a bi-directional ice maker output of the present invention.
Figure 13B:
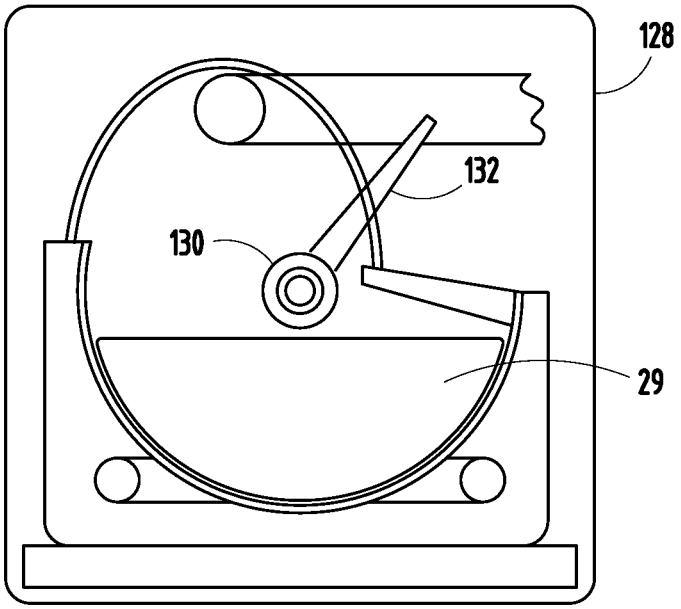
FIG. 13B is a side elevational view of the bi-directional ice maker output of FIG. 13A.
Figure 13C:
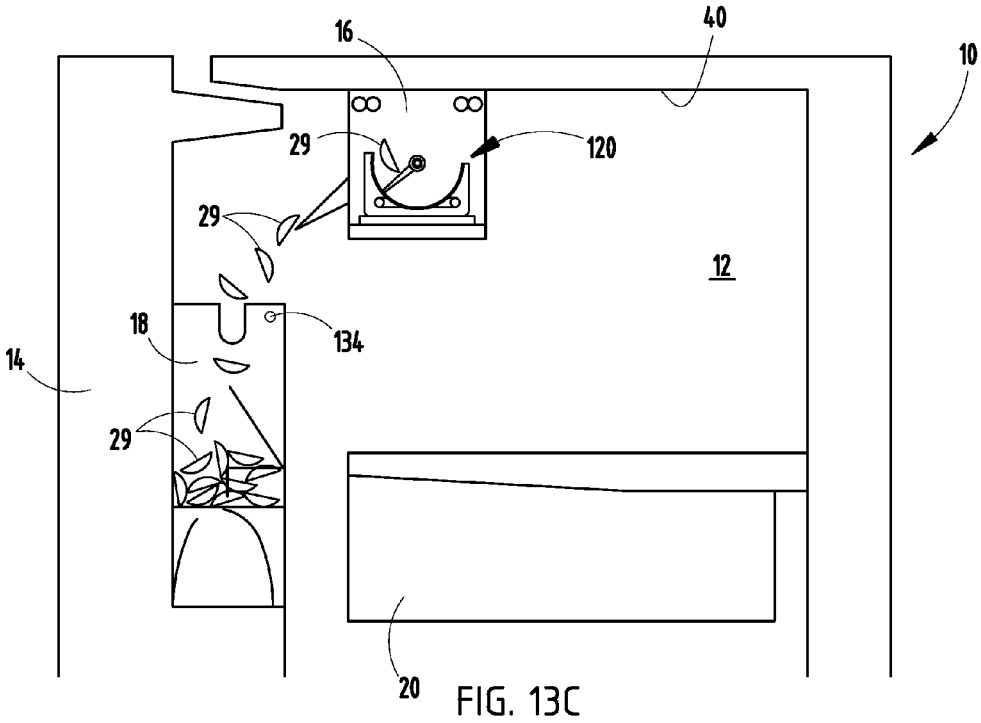
FIG. 13C is a side elevational view of the bi-directional ice maker output of FIG. 13B dispensing ice into a primary ice bin.
Figure 13D:
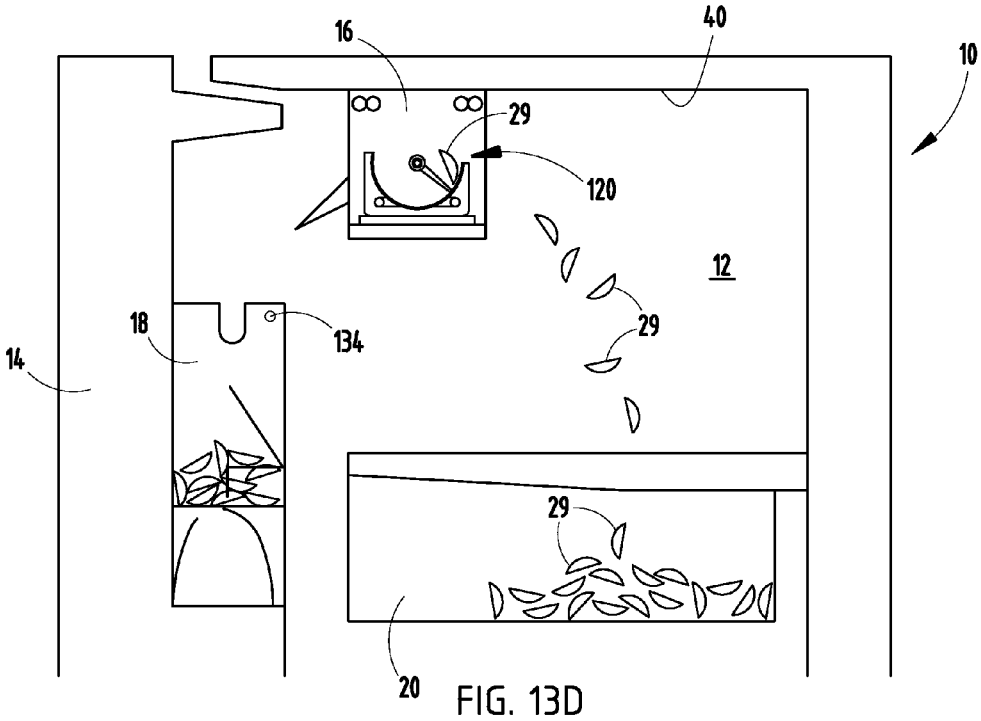
FIG. 13D is a side elevational view of the bi-directional ice maker output of FIG. 13B dispensing ice into a secondary ice bin.

In yet another embodiment, an expandable primary ice bin 18 (in-door ice bucket), as shown in FIGS. 12A and 12B, is provided that has a variable volume reservoir 110, which is positionable in a retracted position 112 and an expanded position 114 expand or retract in order to vary the quantity of ice 29 that it is capable of storing. In the event that a larger volume of ice 29 is needed, the reservoir 110 is expanded by pulling out a front portion of the primary ice bin 18, which effectively increases the volume of ice 29 that the primary ice bin 18 is capable of storing. If less ice 29 is needed, then the front of the primary ice bin 18 is retracted to lessen the volume in the primary ice bin 18.

Referring now to FIGS. 13A-13D, to facilitate management of ice 29 between the primary ice bin 18 and the secondary ice bin 20, a bi-directional ice maker system 120 may be utilized. The bi-directional ice maker system 120 includes an ice maker 122 that is capable of dispensing ice 29 from a front portion 124 of the ice maker 122 or a rear portion 126 of the ice maker 122. This is accomplished by using a bi-directional motor 128 connected with a shaft 130 having a plurality of ice-engaging fingers 132. Counterclockwise rotation of the motor 128 causes the ice-dispensing fingers 132 to dispense ice 29 into the primary ice bin (in-door ice bucket) 18, and clockwise rotation of the motor 128 causes the ice-dispensing fingers 132 to dispense ice 29 into the secondary ice bin (mega bin) 20. An infrared sensor 134 disposed in the primary ice bin 18 may be used to control the motor 128 and define which direction the motor 128 should turn and at what frequency.

Figure 14A:
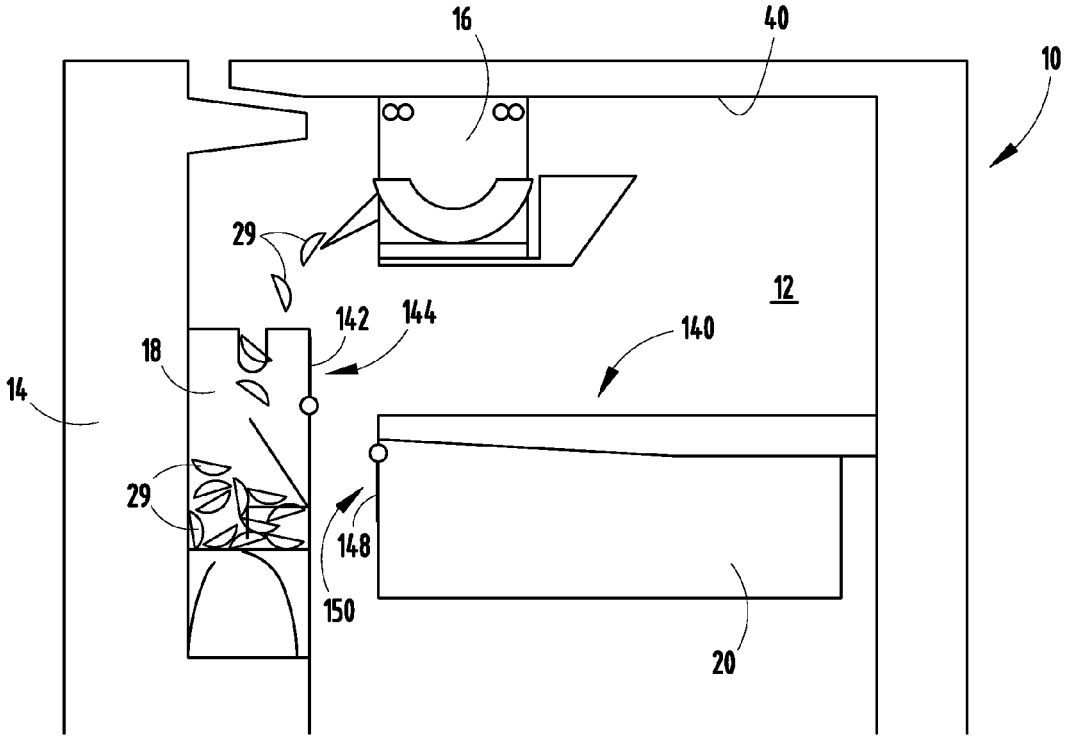
FIG. 14A is a side elevational view of one embodiment of a door overflow transfer system with the doors raised.
Figure 14B:
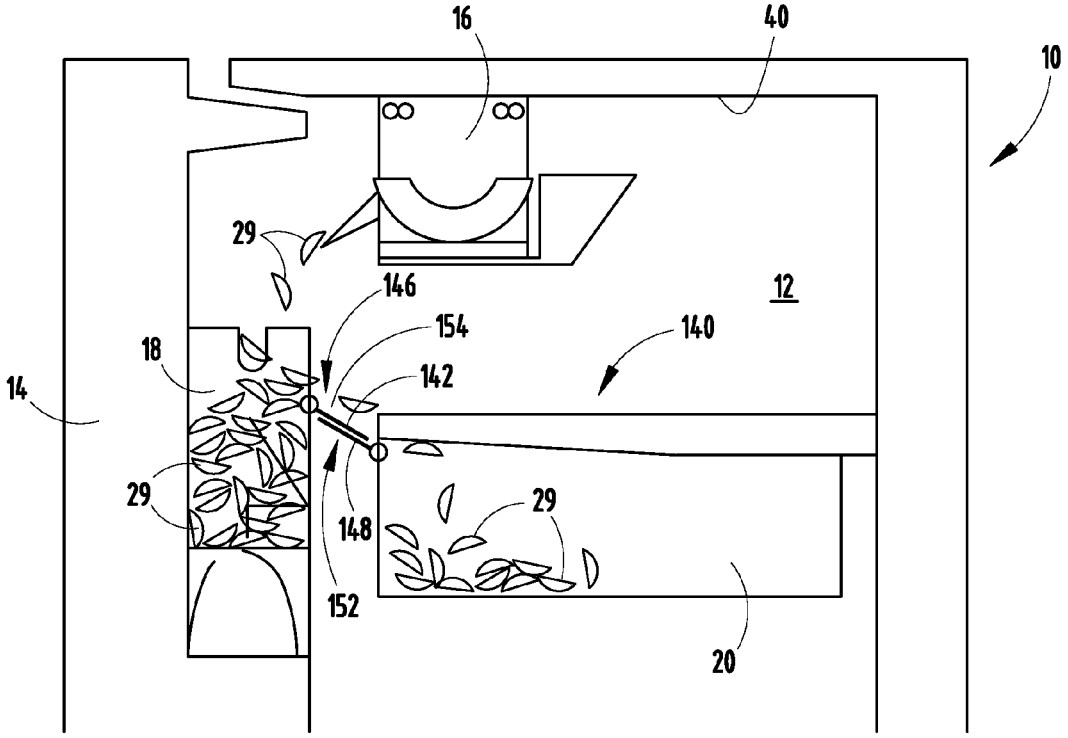
FIG. 14B is a side elevational view of the door overflow transfer system of FIG. 14A with the doors lowered.

Referring to FIGS. 14A and 14B, the illustrated embodiment shows a door overflow transfer system 140. The primary ice bin 18 is disposed on the cabinet door 14 and includes a primary gate 142 operable between a closed position 144 and an open position 146. The secondary ice bin 20 is disposed in the cabinet 12. The secondary ice bin 20 includes a secondary gate 148 operable between a closed position 150 and an open position 152. The secondary gate 148 operably engages with the primary gate 142 to form an ice overflow route 154 (FIG. 14B) when both the primary gate 142 and the secondary gate 148 are in the open position 146, 152. The ice maker 16 is disposed inside the cabinet 12 and dispenses ice 29 into the primary ice bin 18. When the volume of ice 29 reaches the sensor disposed in the cabinet 12, the ice maker 16 is instructed to either stop making ice 29 or the primary gate 142 and secondary gate 148 are opened to create the ice overflow route 154. It is conceived that the primary gate 142 and secondary gate 148 may abut or include a latch (not shown) that temporarily holds the gates 142, 148 together. The primary and secondary gates 142, 148 maintain the ice overflow route 154 until sufficient ice 29 is dispensed into the secondary ice bin 20 and the user turns the ice maker 16 off or until a predetermined maximum ice 29 level is reached in the secondary ice bin 20, as determined by the sensor.

Figure 15:
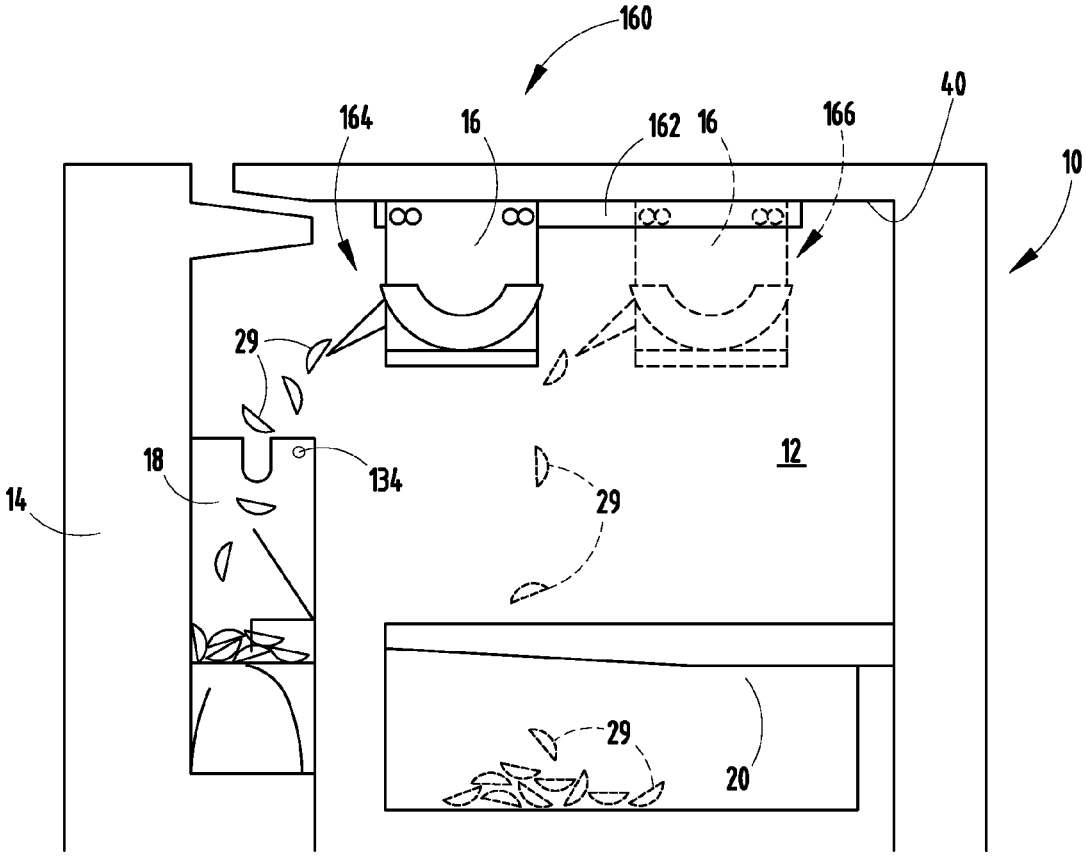
FIG. 15 is a side elevational view of a sliding ice maker system.

Referring now to FIG. 15, the illustrated embodiment includes a sliding ice maker system 160. The sliding ice maker 16 transfers ice 29 to a selected bin 18, 20 (in-door ice bucket or mega bin) by sliding on a rail system 162 to a selected dispensing position. In a first forward position 164, the ice 29 is dispensed into the primary ice bin 18. In a second rearward position 166, ice 29 is dispensed into the secondary ice bin 20. As with the bi-directional ice maker system 120, infrared sensors 134 that are operably connected with the sliding ice maker system 160 will control when ice 29 is distributed to the primary ice bin 18 and when ice 29 is distributed to the secondary ice bin 20 and at what frequency.

Figure 16A:
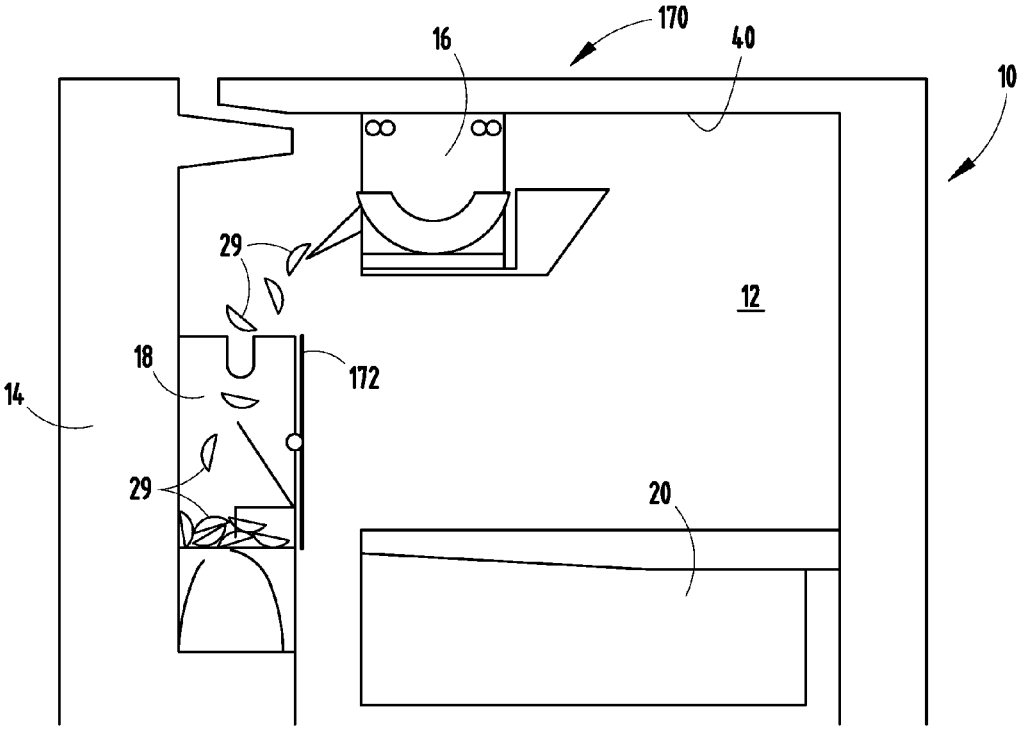
FIG. 16A is a side elevational view of a ramp door gravity transfer system with a transfer ramp in the open position.
Figure 16B:
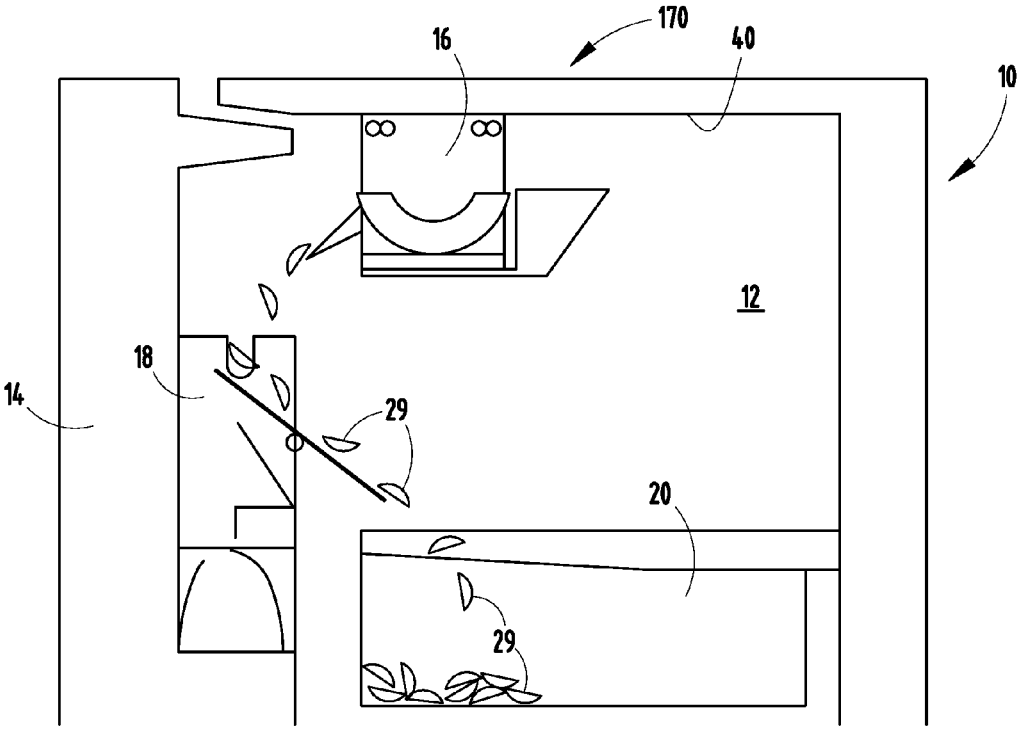
FIG. 16B is a side elevational view of the ramp door gravity transfer system of FIG. 16A with the transfer ramp in the re-directing position.

In the illustrated embodiment shown in FIGS. 16A and 16B, a ramp door gravity transfer system 170 is used to transfer ice 29 from the ice maker 16 to the secondary ice bin 20 by bypassing the primary ice bin 18. A transfer ramp 172 on the primary ice bin 18 opens to transfer ice 29 to the secondary ice bin 20. The ramp 172 is hinged along a mid-section thereof, which allows the ramp 172 to cover the primary ice bin 18 and redirect ice 29 that falls from the ice maker 16 directly to the secondary ice bin 20 without ever entering the primary ice bin 18. Stated differently, this transfer method prohibits ice 29 from entering the primary ice bin 18.

Figure 17A:
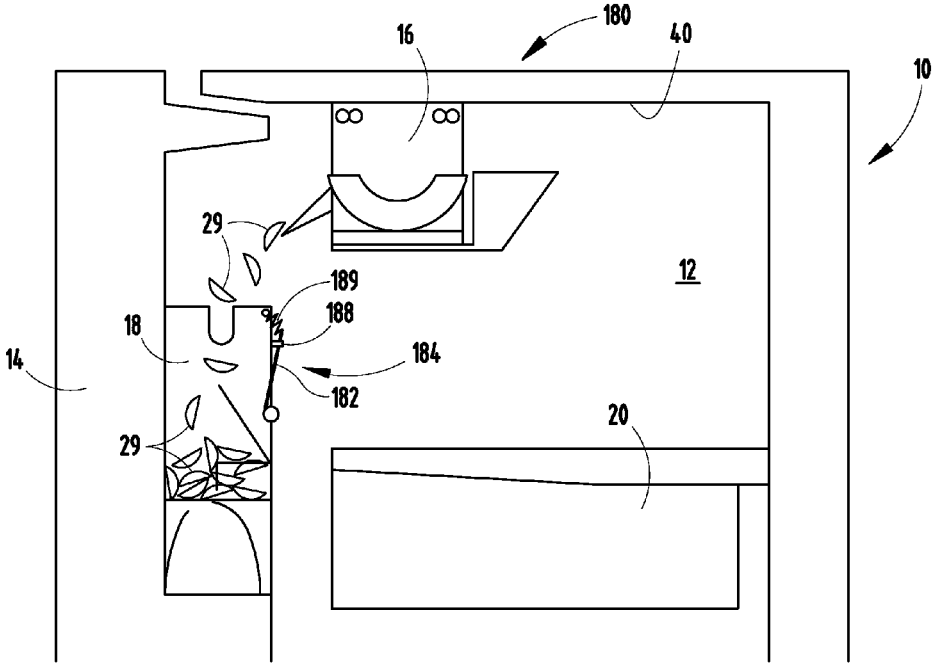
FIG. 17A is a side elevational view of one embodiment of a spring-biased door system of the present invention with the door in the closed position.
Figure 17B:
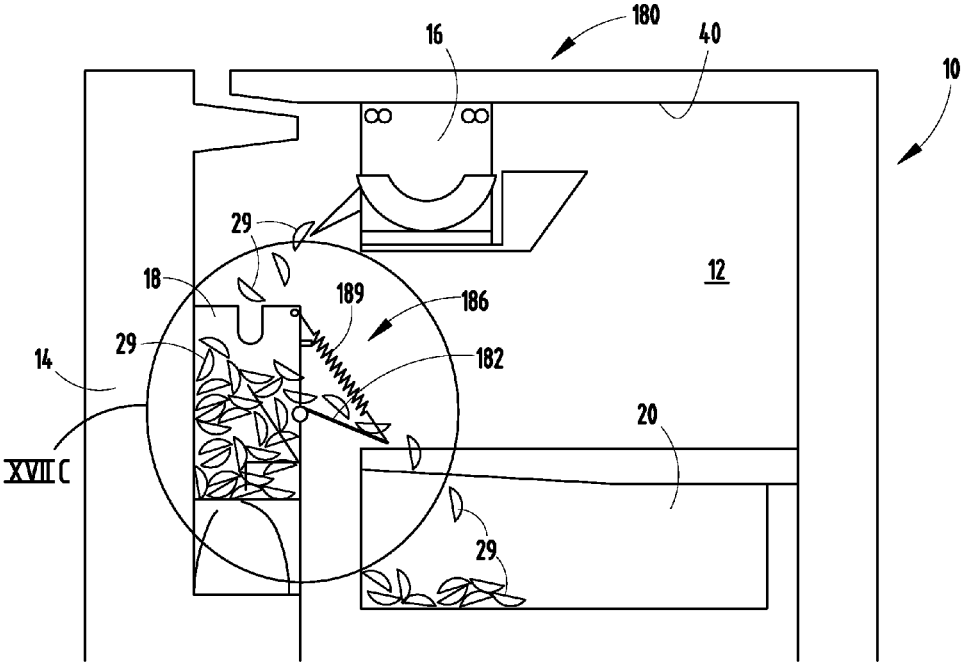
FIG. 17B is a side elevational view of the spring-biased door system of FIG. 17A with the door in the lowered open position.
Figure 17C:
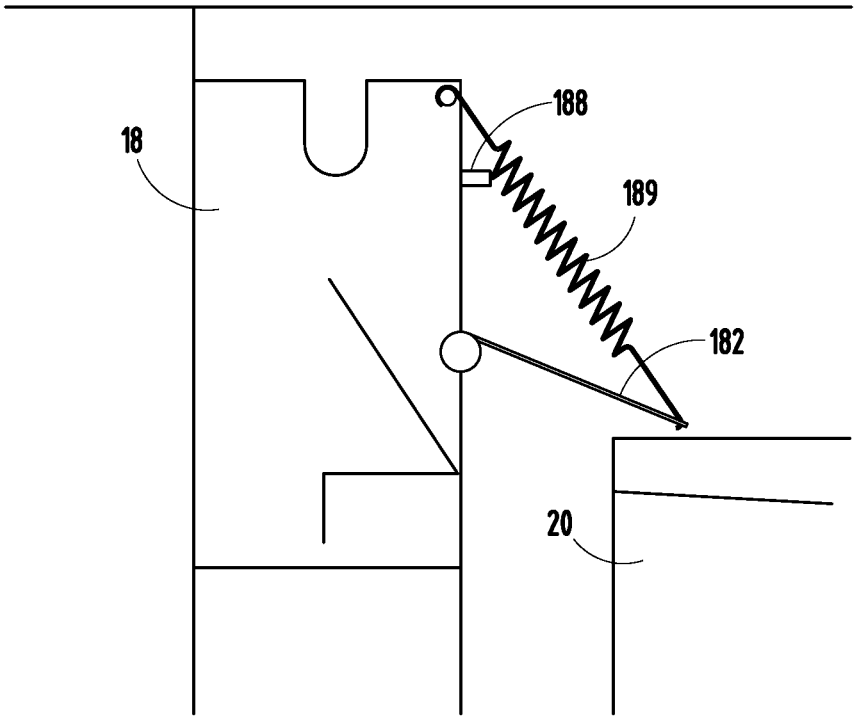
FIG. 17C is an enlarged partial view of the area XVIIC of FIG. 17B.

Referring now to FIGS. 17A-17C, a spring-loaded door system 180 transfers ice 29 from the ice maker 16 to the secondary ice bin 20 by use of the primary ice bin 18. Specifically, as ice 29 is dispensed from the ice maker 16, the ice 29 fills the primary ice bin 18. A spring-biased door 182 is operable between a closed position 184 and an open position 186. When a certain ice 29 level is achieved in the primary ice bin 18, additional ice 29 pushes through the spring-biased door 182 located at the top of the front side of the primary ice bin 18. When pushed open, the spring-biased door 182 acts as a ramp, allowing excess ice 29 to spill into the secondary ice bin 20. Accordingly, ice 29 is transferred by indirect means from the ice maker 16 to the secondary ice bin 20. A latch 188 included on the spring-biased door 182 stops transfer to the secondary ice bin 20 when closed, resuming normal primary ice bin 18 production. This method of transfer allows for continued primary ice bin 18 dispensing, even when the secondary ice bin 20 storage is activated. A spring 189 used in the spring-loaded door system 180 has a tensile force strong enough to maintain the spring-biased door 182 in the closed position 184, but is sufficiently resilient to allow the weight of the ice 29 to push the spring-biased door 182 to the open position 186, such that the ice 29 flows into the secondary ice bin 20.

Figure 18A:
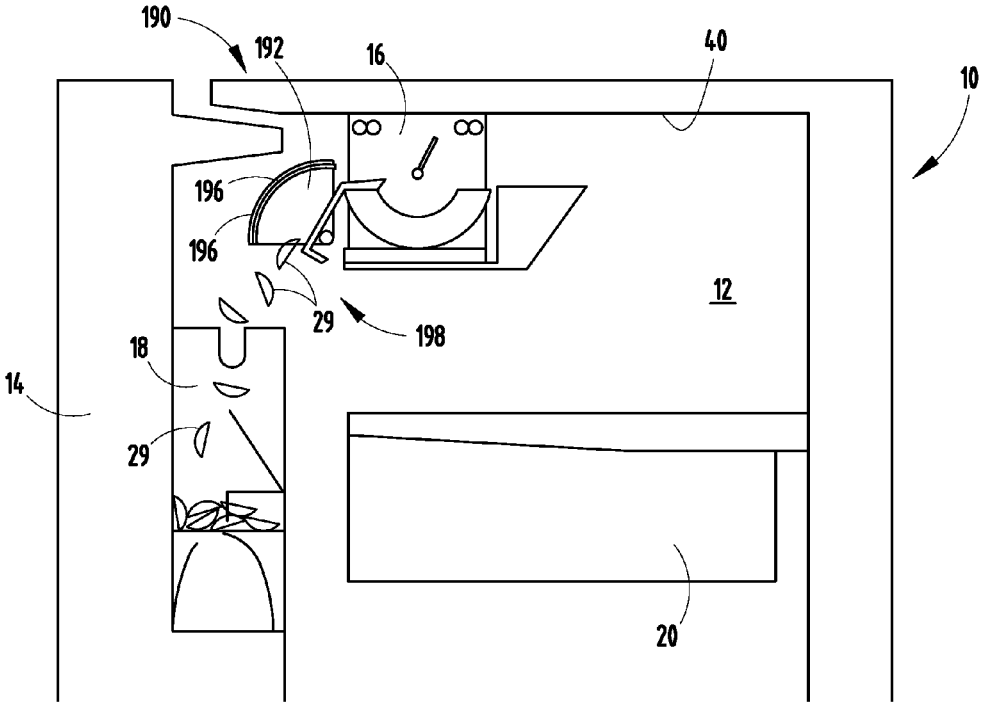
FIG. 18A is a side elevational view of one embodiment of an ice maker redirect system of the present invention with the chute raised.
Figure 18B:
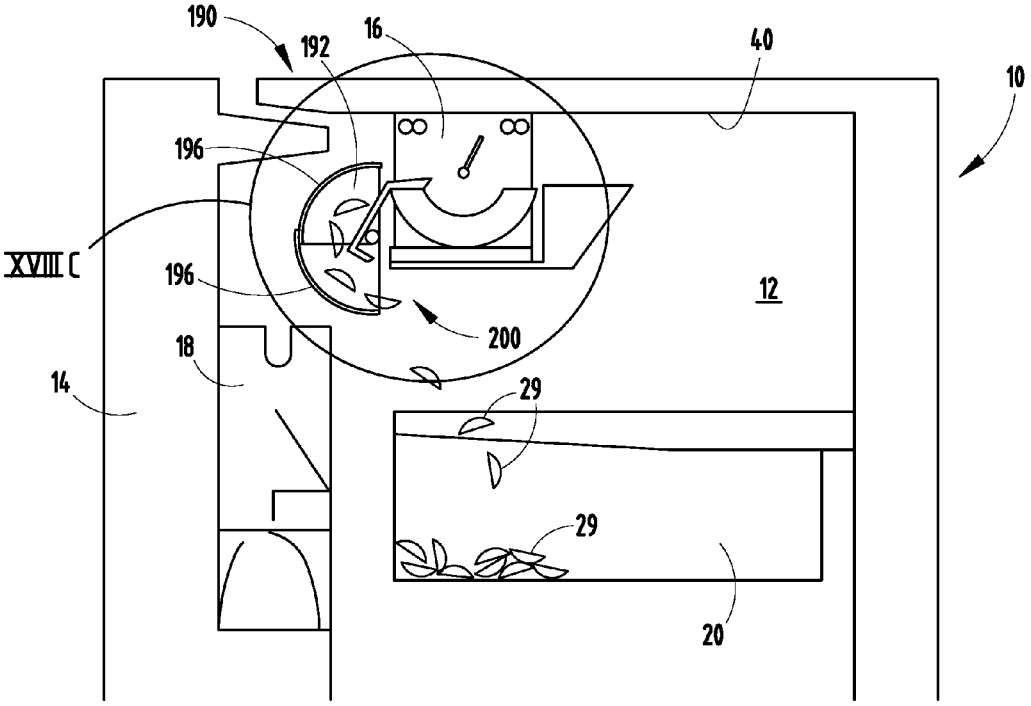
FIG. 18B is a side elevational view of the ice maker redirect system with the chute lowered.
Figure 18C:
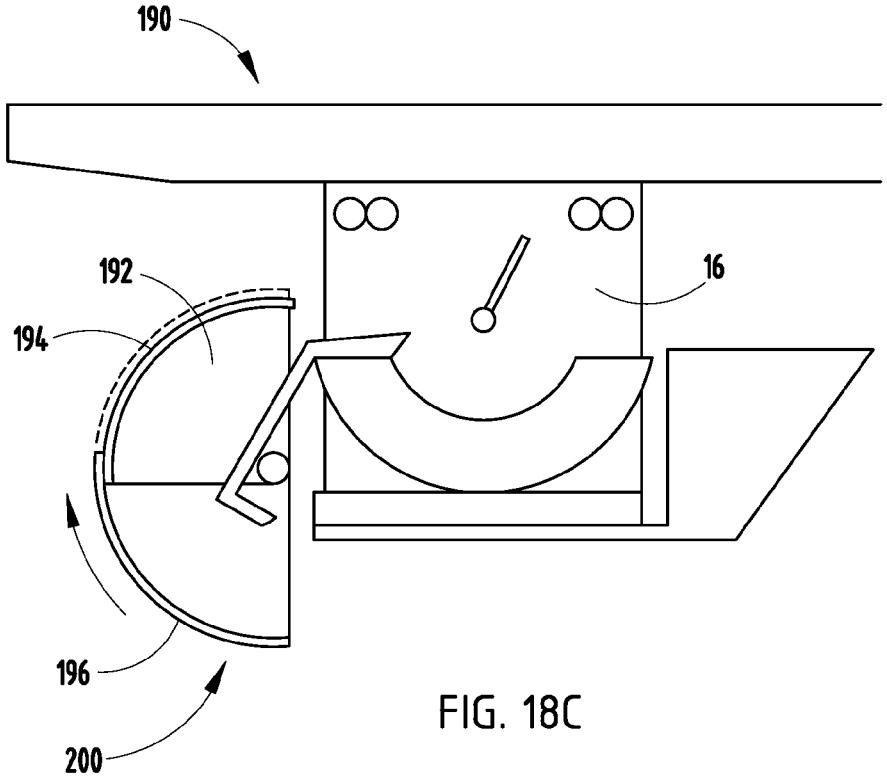
FIG. 18C is an enlarged partial view of the area XVIIIC of FIG. 18B.

Referring now to FIGS. 18A-18C, an ice maker redirect chute system 190 utilizes a redirecting chute 192 that allows transfer of ice 29 to the primary ice bin 18 or to the secondary ice bin 20. The chute 192 includes first and second arcuate members 194, 196 that are slidably engageable. When the second arcuate member 196 is raised, the chute 192 is in an open position 198, and the ice maker 16 dispenses ice 29 to the primary ice bin 18. When the second arcuate member 196 is lowered, the chute 192 is in a closed position 200, and ice 29 is redirected to fall into the secondary ice bin 20. The first arcuate member 194 is fixedly attached to an interior wall of the cabinet 12.

Figure 19:
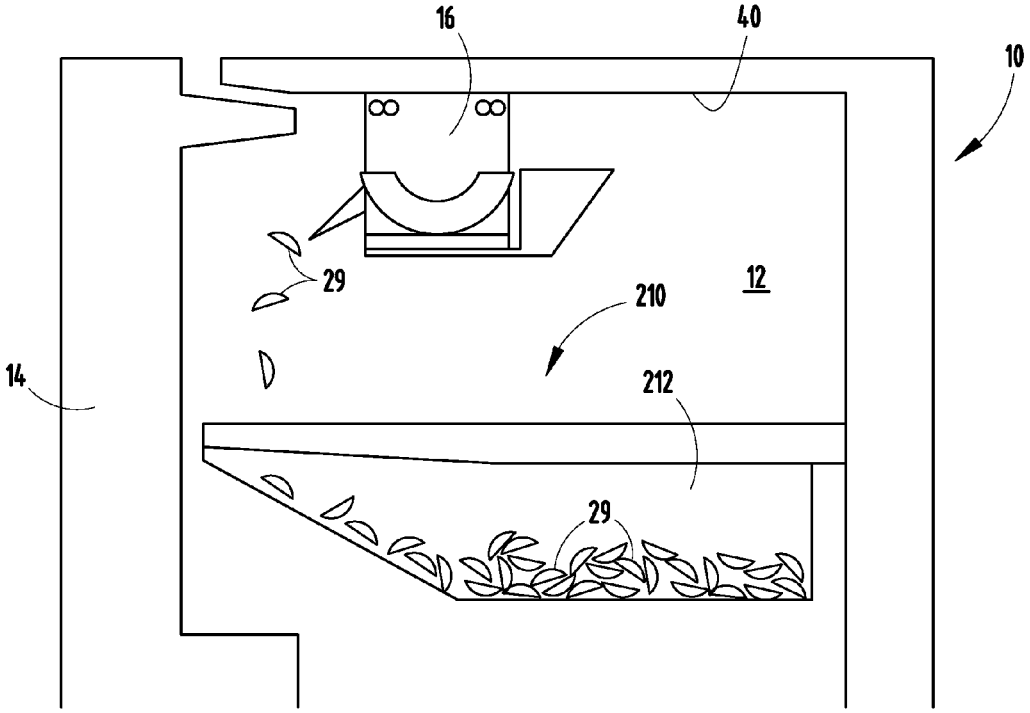
FIG. 19 is a side elevational view of an ice maker disposing ice into an extended secondary ice bin.

Referring now to FIG. 19, an extended mega bin system 210 is used when a large volume of ice 29 is needed and the primary ice bin 18 is not desired, and therefore not installed in the cabinet door 14. Ice 29 is transferred from the ice maker 16 to an enlarged ice bin 212 by ejecting ice 29 into the area normally filled by the primary ice bin 18. As ice 29 is dispensed from the ice maker 16, the ice 29 falls directly into the enlarged ice bin 212. All external ice 29 dispensing is unavailable as the primary ice bin 18 is not operably connected with the external ice dispenser.

Figure 20:
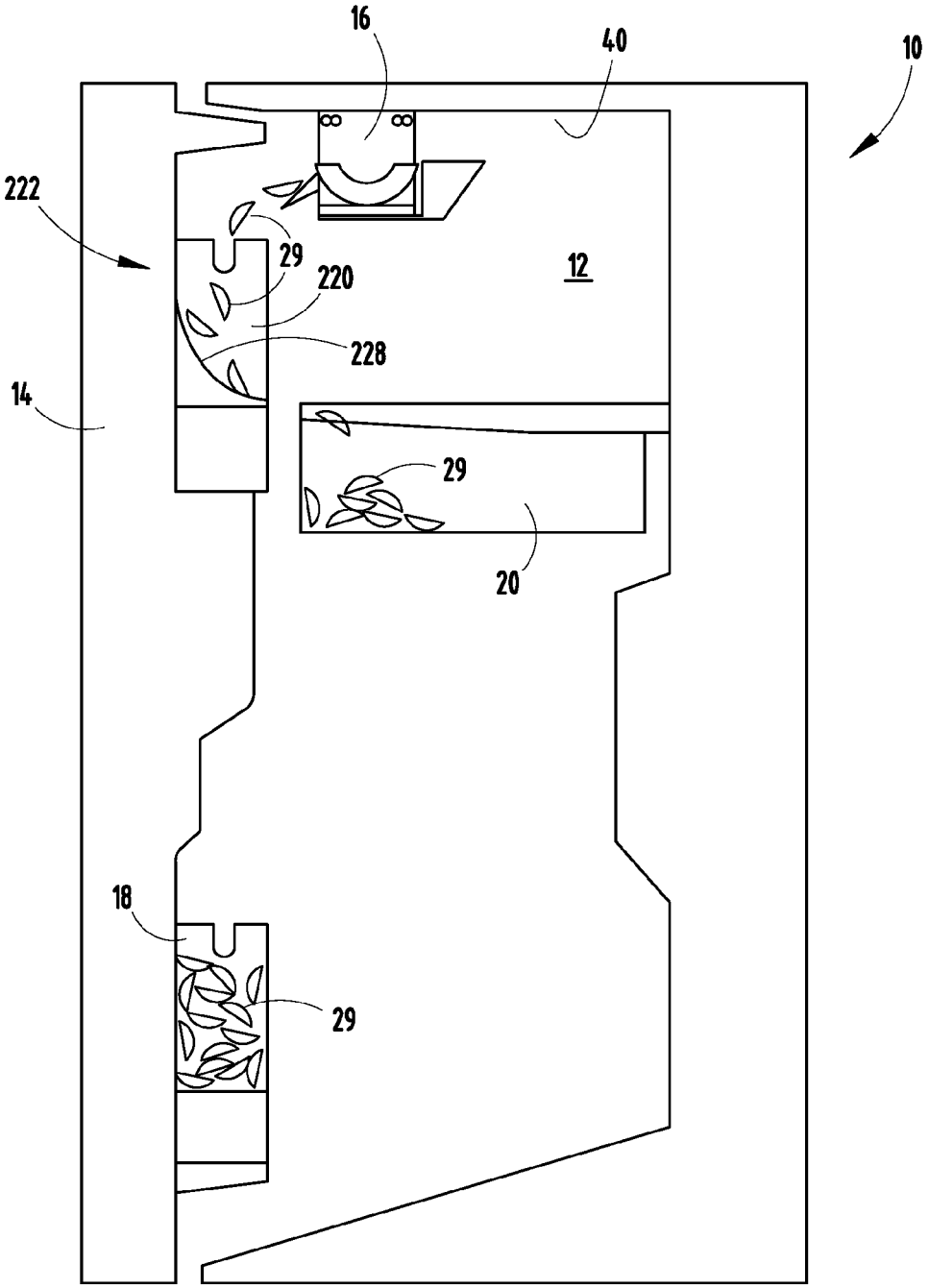
FIG. 20 is a side elevational view of an in-door ice replacement chute directing ice to a secondary storage bin.

Referring now to FIG. 20, an in-door ice replacement chute system 220 includes a replacement chute device 222 that takes the place of the primary ice bin 18. Ice 29 is transferred from the ice maker 16 to the secondary ice bin 20 by replacing the primary ice bin 18 with the replacement chute device 222 that fits into the space generally occupied by the primary ice bin 18. The replacement chute device 222 includes a curved ramp 228 that directs ice 29 to the secondary ice bin 20. No ice 29 is stored in the chute device 222. As ice 29 is dispensed by the ice maker 16, it is routed down the curved ramp 228 and into the secondary ice bin 20.

Figure 21:
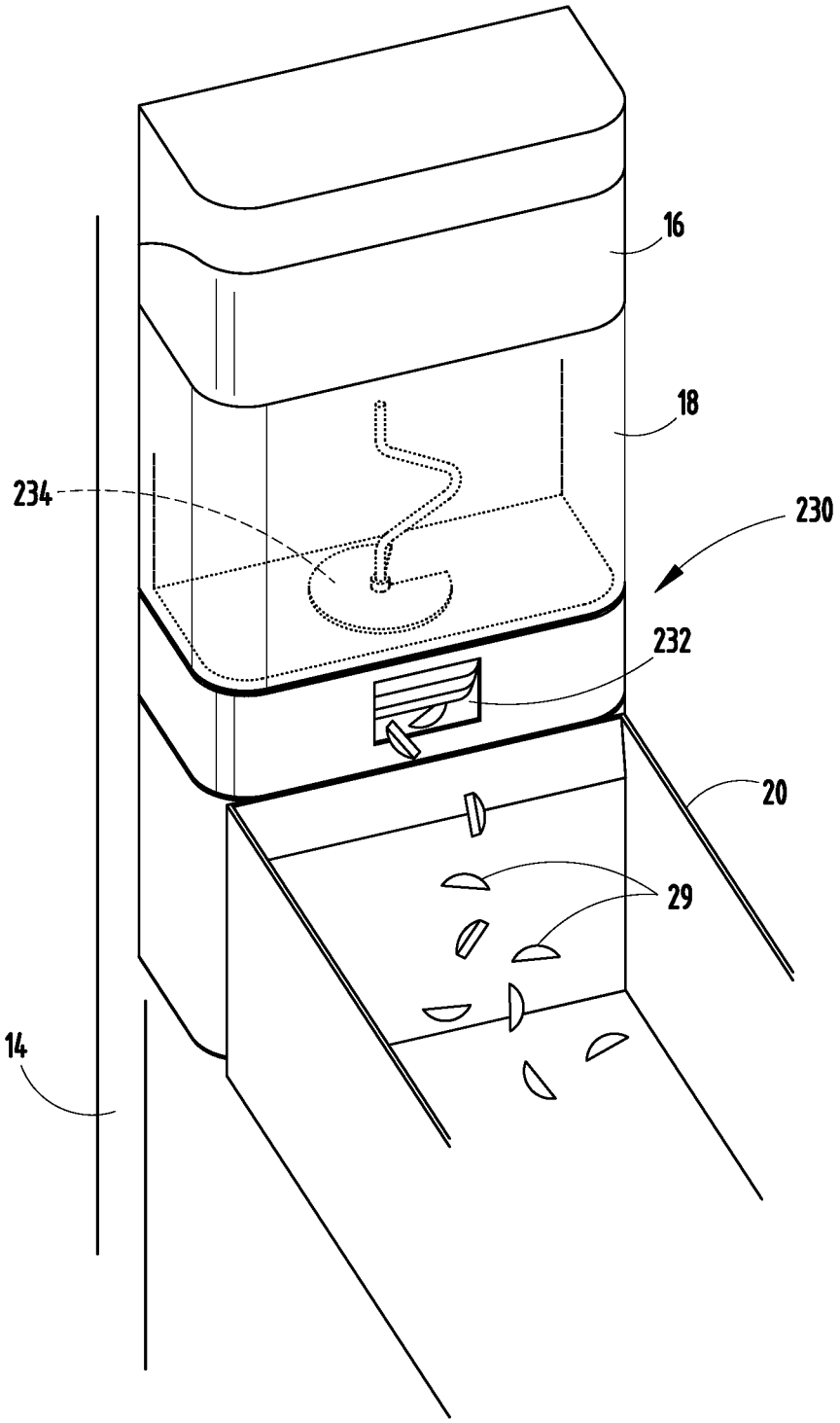
FIG. 21 is a top perspective view of a trapdoor auger transfer system directing ice from the in-door ice bucket through a trap door to the secondary storage bin.

Referring now to FIG. 21, one embodiment of a trapdoor auger transfer system 230 includes a trapdoor 232 that allows ice 29 to be transferred from the ice maker 16 (in-door ice maker) to the secondary ice bin 20. Ice 29 is propelled from the primary ice bin 18 through the trapdoor 232 with an auger mechanism 234 disposed in the primary ice bin 18. To activate the secondary ice bin 20, the trapdoor 232 is manually or mechanically opened. As ice 29 is dispensed from the ice maker 16, the auger mechanism 234 is activated in a cubed ice direction to eject ice 29 out the trapdoor 232 to the secondary ice bin 20.

Figure 22:
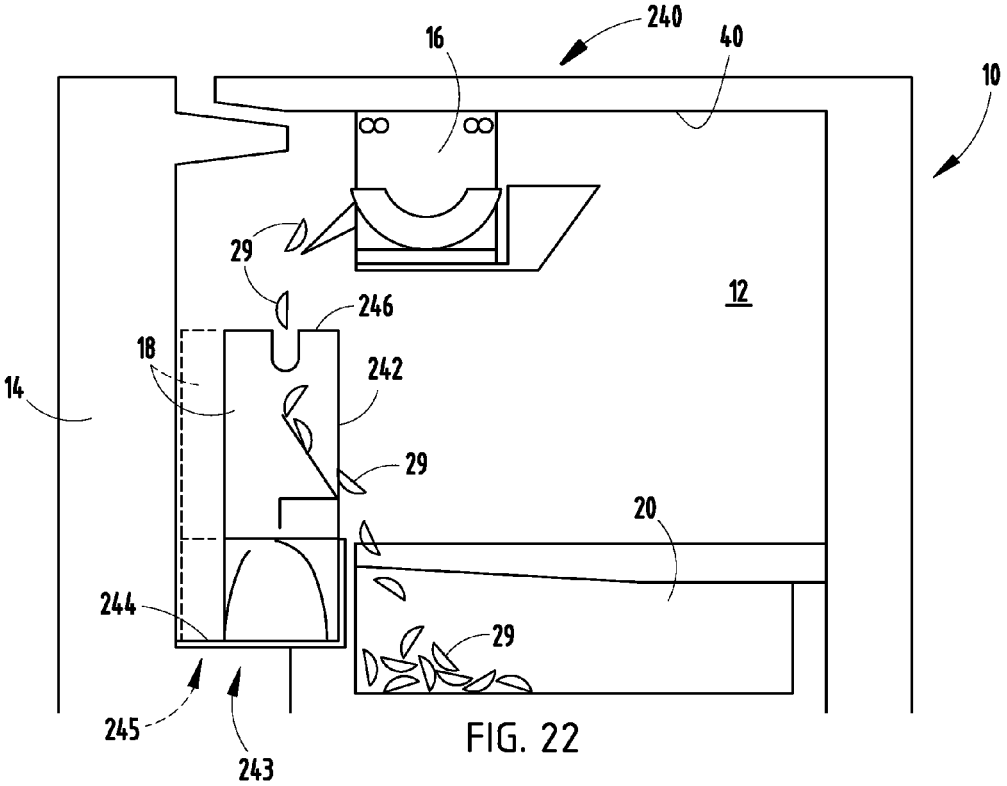
FIG. 22 is a side elevational view of one embodiment of a sliding in-door ice bucket system.

FIG. 22 illustrates one embodiment of a sliding primary ice bin system 240 that transfers ice 29 from the ice maker 16 to the secondary ice bin 20 by positioning the primary ice bin 18 to simultaneously receive ice 29 from the ice maker 16 and dispense the ice 29 to the secondary ice bin 20. This feature is accomplished by providing a modified primary ice bin 242 that can slide to a forward position 243 from an in-door position 245 on a rail system 244. The modified primary ice bin 242 is positioned forward slightly so that the bottom of the modified primary ice bin 242 can dispense ice 29 directly into the secondary ice bin 20 while still receiving ice 29 from the ice maker 16 through a top opening 246 of the modified primary ice bin 242.

Figure 23:
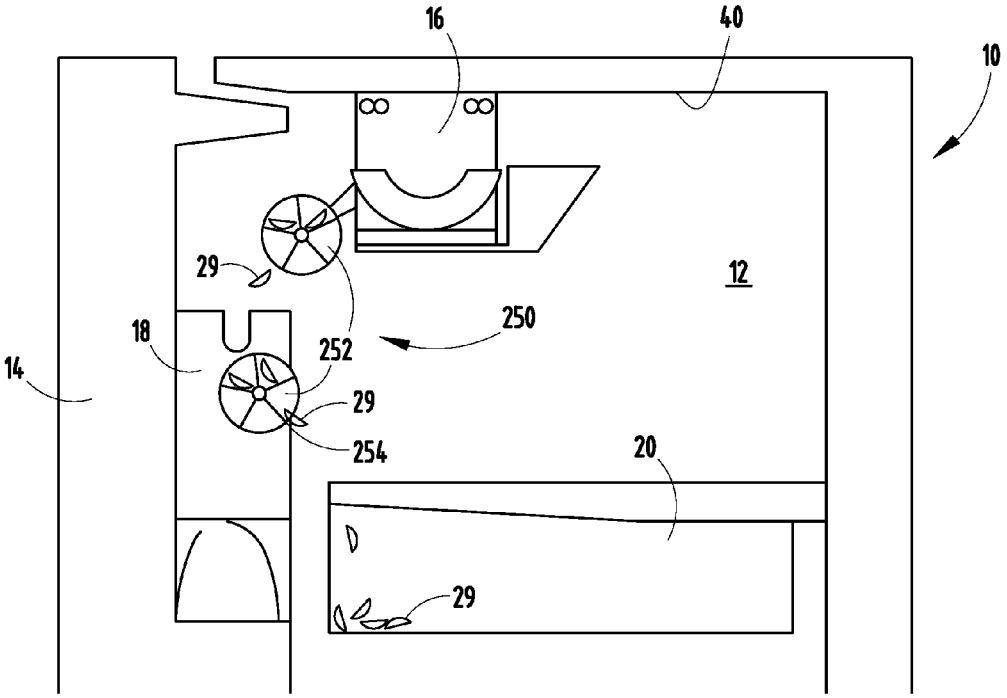
FIG. 23 is a side elevational view of one embodiment of a paddle wheel system.

Referring now to FIG. 23, the illustrated embodiment of a paddle wheel system 250 transfers ice 29 from the ice maker 16 to the secondary ice bin 20 by using two paddle wheels 252 rotatably connected with the primary ice bin 18. As ice 29 is dispensed from the ice maker 16 to the primary ice bin 18, the paddle wheels 252 located in the storage area of the primary ice bin 18 rotate. The paddle wheels 252 catch the ice 29 and simultaneously propel the ice 29 through a dispensing aperture 254 into the primary ice bin 18 to the secondary ice bin 20.

Figure 24A:
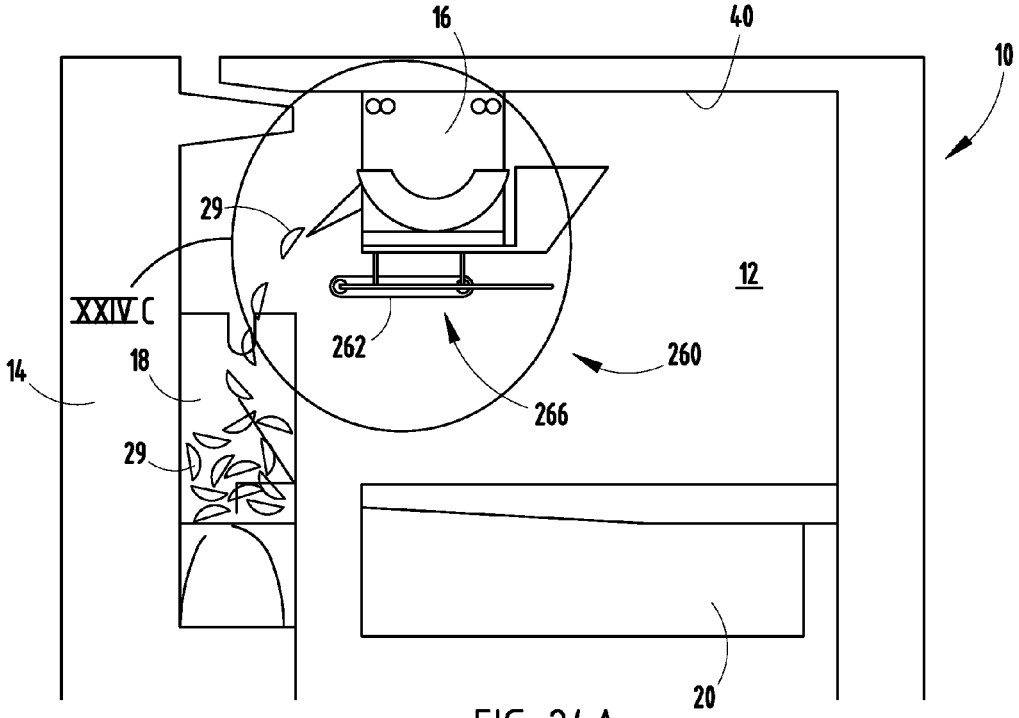
FIG. 24A is a side elevational view of one embodiment of a conveyor belt system with the conveyor belt in the retracted position.
Figure 24B:
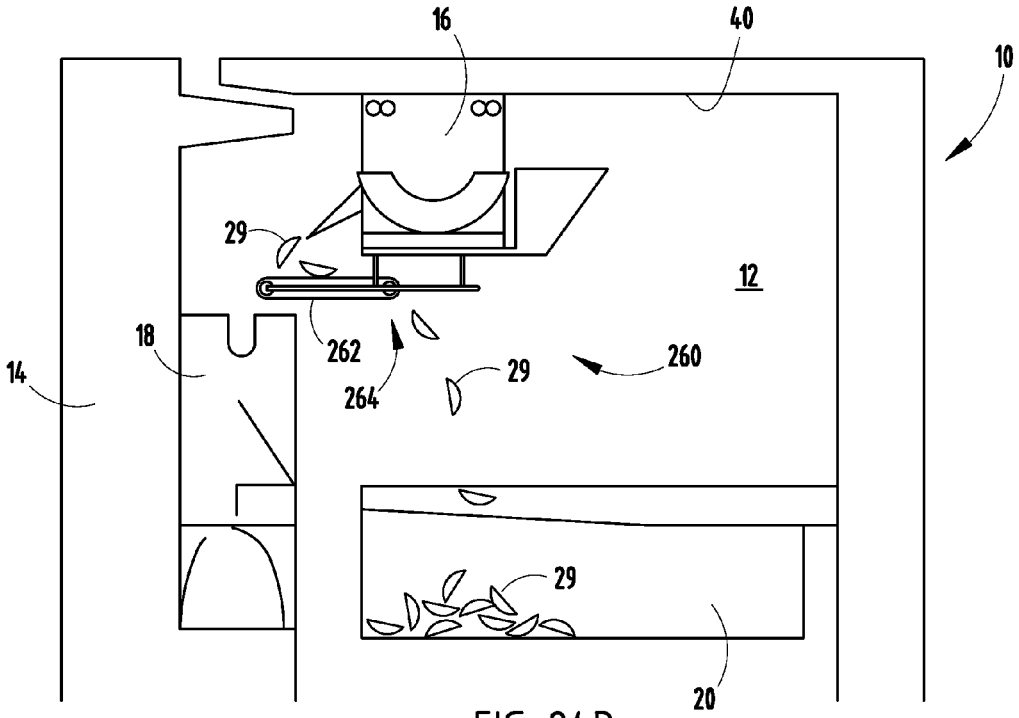
FIG. 24B is a side elevational view of the conveyor belt system of FIG. 24A with the conveyor belt in the extended position.
Figure 24C:
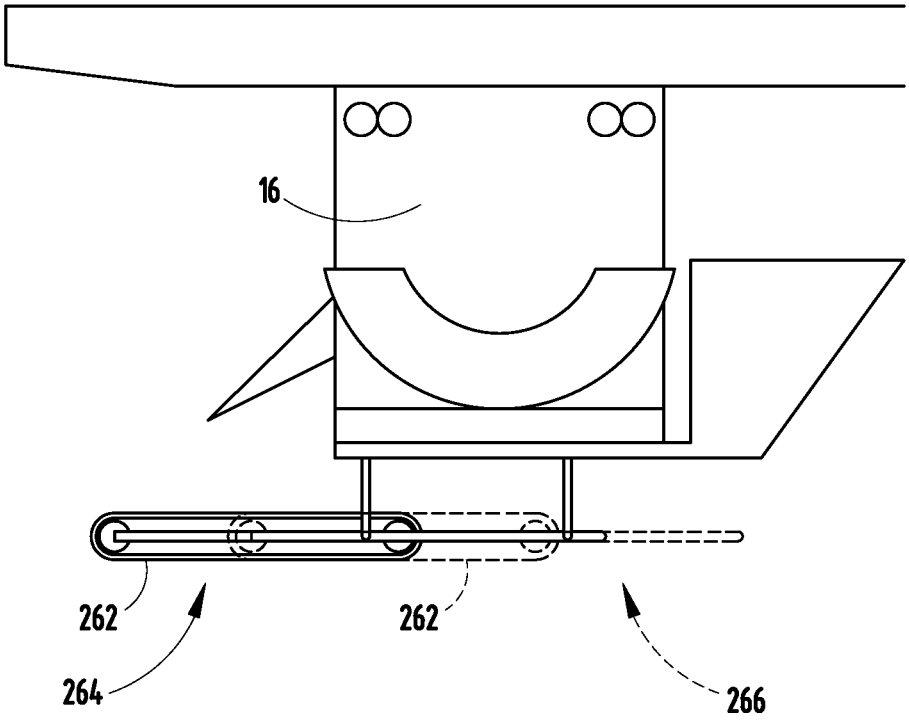
FIG. 24C is an enlarged partial view of the area XXIVC of FIG. 24B.

The embodiment illustrated in FIGS. 24A-24C shows a conveyor belt system 260 that transfers ice 29 from the ice maker 16 to the secondary ice bin 20 by utilizing a conveyor belt mechanism 262 disposed above the primary ice bin 18. When in use, the conveyor belt mechanism 262 is slid forward to a first position 264. When the secondary ice bin 20 is not in use, the conveyor belt mechanism 262 can be moved rearward to a second position 266 to allow for normal ice dispensing. The conveyor belt mechanism 262 may include a stand alone motor or may be connected with the motor that powers the ice maker 16.

Figure 25:
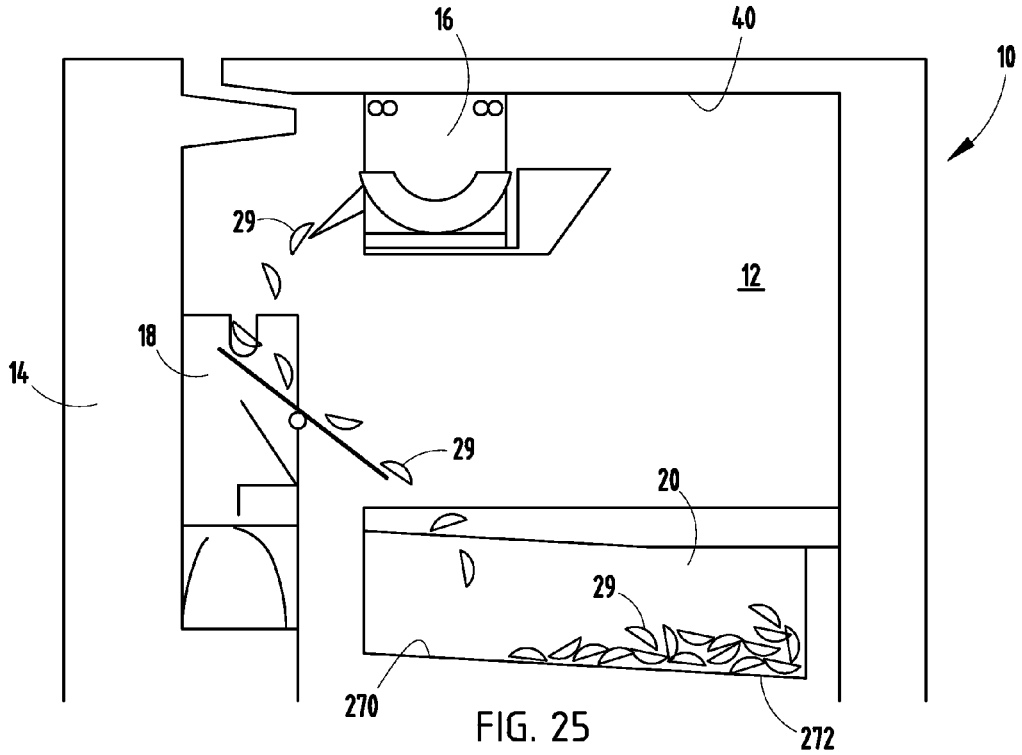
FIG. 25 is a side elevational view of one embodiment of a built-in dispersion slope in the secondary ice bin.
Figure 26:
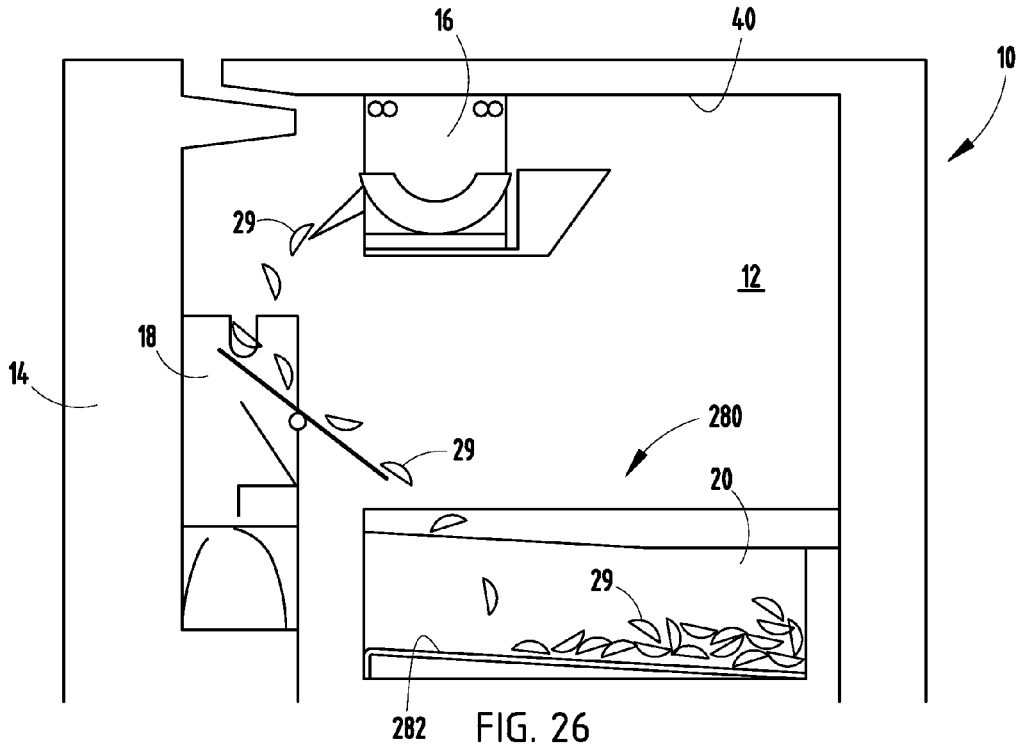
FIG. 26 is a side elevational view of a removable dispersion slope in a secondary ice bin.

Referring now to FIGS. 25 and 26, different concepts have been contemplated to disperse ice 29 inside the secondary ice bin 20. Specifically, the secondary ice bin 20 may include a dispersion slope 270 integral with the secondary ice bin 20 that uniformly distributes ice 29 across the secondary ice bin 20. The secondary ice bin 20 slopes gently downward towards a rear 272 of the secondary ice bin 20 and is part of the secondary ice bin 20 geometry. Another embodiment (FIG. 26) includes a removable dispersion slope system 280 that utilizes a sloped insert 282 that uniformly distributes ice 29 in the secondary ice bin 20, but which can be removed if a user desires more volume with less dispersion ability. Other ice bin constructions and dispersion methods are also contemplated, such as those described in "MEGA ICE BIN," U.S. Patent Application Publication No. 2011/0138828, published on Jun. 16, 2011, the entire disclosure of which is hereby incorporated herein by reference.

Figure 27:
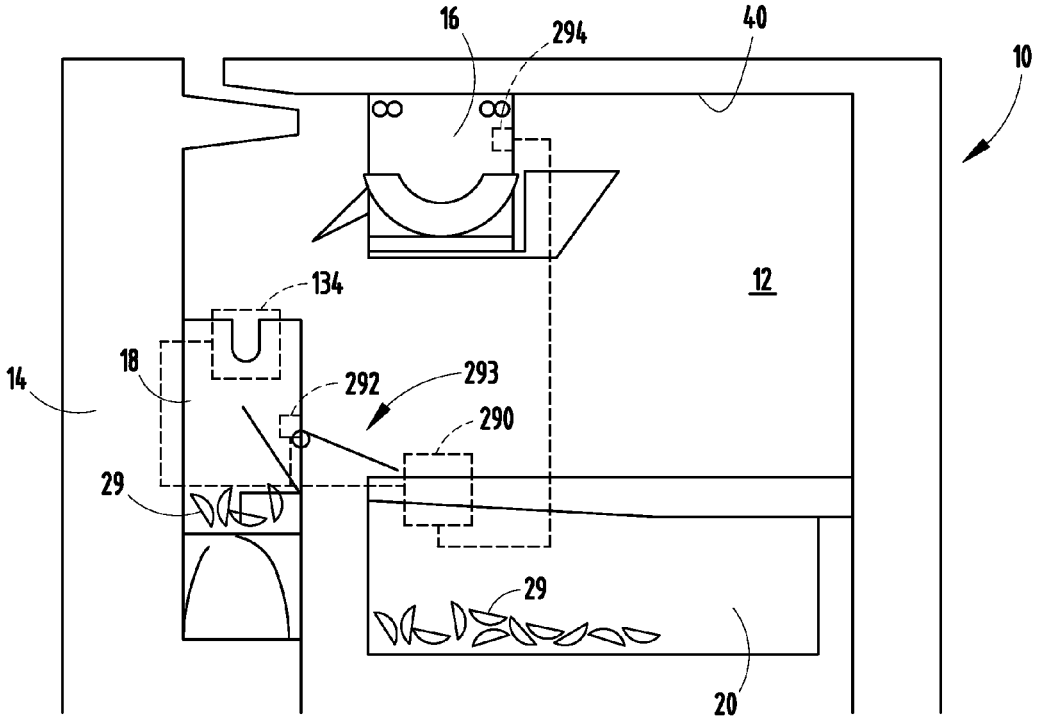
FIG. 27 is a side elevational view of one embodiment of a sensor system incorporating first and second infrared sensors.
Figure 28:
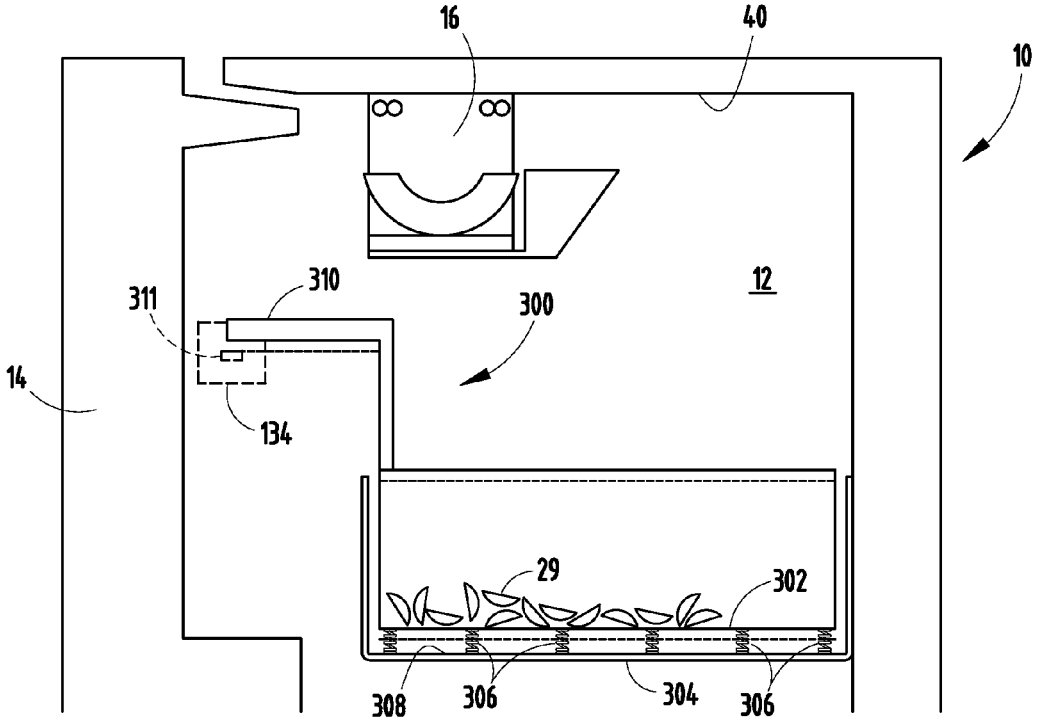
FIG. 28 is a side elevational view of one embodiment of a hybrid weight infrared sensor system.
Figure 29:
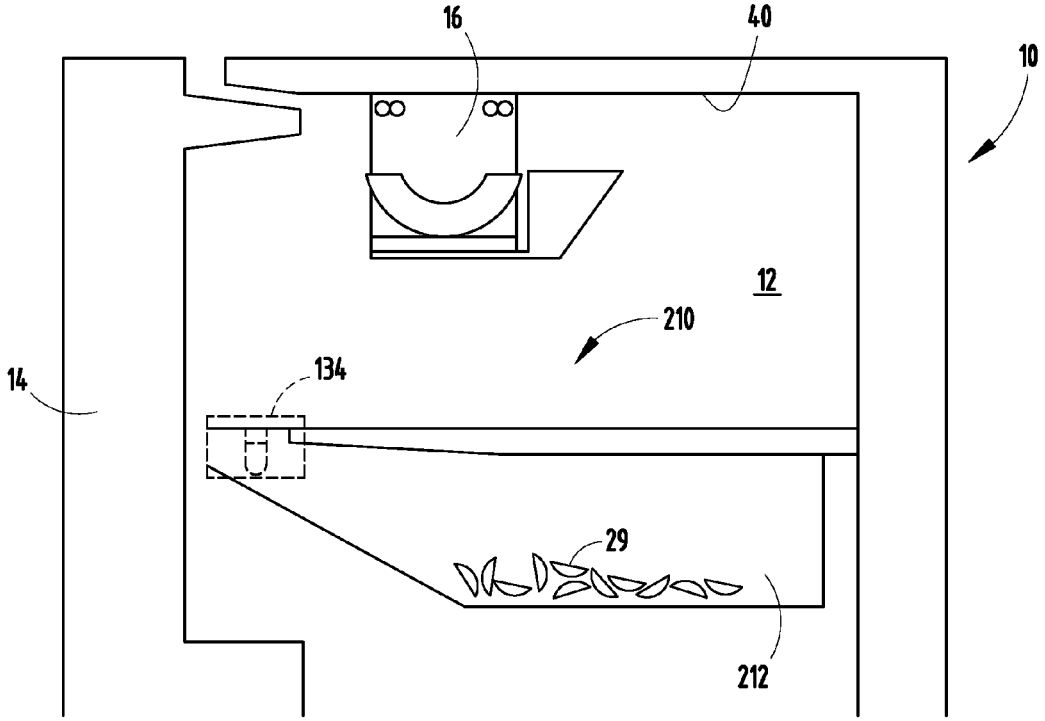
FIG. 29 is a side elevational view of one embodiment of an extended mega bin utilizing an existing infrared system.

Referring now to FIGS. 27-29, various sensor systems may be used to determine the level of ice 29 in the primary ice bin 18 or the secondary ice bin 20. In the embodiment illustrated in FIG. 27, a second infrared sensor 290 is disposed in the secondary ice bin 20 and is linked to the primary sensor 134 disposed in the primary ice bin 18. Accordingly, when sufficient ice 29 has been provided in the primary ice bin 18, the primary sensor 134 sends a signal to a motor control 292 for a transfer system 293, such as several of those disclosed above, to open, thereby allowing ice 29 to flow from the primary ice bin 18 to the secondary ice bin 20. When the secondary ice bin 20 has reached full capacity, the second infrared sensor 290 sends a signal to a control 294 on the ice maker 16 to discontinue the manufacture of ice 29. Alternatively, the primary sensor 134 may send a signal to a visual display on the appliance 10 requesting confirmation that the transfer system 293 be activated to relay ice to the secondary ice bin 20.

Another embodiment of a sensor system, as shown in FIG. 28, includes a hybrid weight infrared sensor system 300. The hybrid weight infrared sensor system 300 detects the level of the ice 29 by utilizing Hooks-spring equation $F=K\Delta x$. The secondary ice bin 20 includes both an inner bin 302 and an outer bin 304. The inner bin 302 sits on springs 306 that are affixed to an interior 308 of the outer bin 304. The spring constant related to these springs 306 is selected to control the deflection of the inner bin 302 as the weight of the ice 29 increases. As the inner bin 302 descends due to the weight of the ice 29, a plastic flag 310 attached to the inner bin 302 deflects by the same amount. When the inner bin 302 is full of ice 29 (as determined by the volume of the inner bin 302 and the packing density of ice cubes), the flag 310 will have deflected downward enough to cover an eye 311 of the existing infrared sensor 134, thereby stopping ice 29 production and preventing overflow of the inner bin 302.

Referring now to FIG. 29, the extended mega bin system 210 may be designed for use with the existing infrared sensor 134. Specifically, the enlarged ice bin 212 extends far enough to reach the eye 311 in the infrared sensor 134. When ice 29 reaches a maximum volume, the eye is blocked, and consequently sends a signal to the ice maker 16 to discontinue the manufacturing of ice 29. Alternatively, a microcontact sensor system may also be used, which detects the ice 29 level by utilizing a microcontact sensor at the end of a fold-out door on the primary ice bin 18. When the primary ice bin 18 door is opened to activate the secondary ice bin 20 fill, the sensor is positioned at the top of the secondary ice bin 20. When the ice 29 reaches the top of the secondary ice bin 20, the sensor is tripped and ice 29 production is stopped.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A refrigerator comprising:

a cabinet including a cabinet door pivotally connected thereto;

a primary ice bin disposed on one of the cabinet and the cabinet door including a primary gate operable between a closed position and an open position;

a secondary ice bin that serves as an ice overflow reservoir and that is disposed on the other of the cabinet and the cabinet door, the secondary ice bin including a secondary gate operable between a closed position and an open position, wherein the secondary gate operably engages with the primary gate to form an ice overflow route when the primary gate and the secondary gate are in the open position; and an ice maker disposed inside the cabinet and adapted to dispense ice into the primary ice bin, wherein ice is diverted by the primary gate and the secondary gate to the secondary ice bin from the primary a ice bin when mar ice bin has reached a maximum capacity.

2. The refrigerator of claim 1, wherein the secondary ice bin includes a dispersion slope integral with a bottom wall of the secondary ice bin.

3. The refrigerator of claim 1, further comprising:

a sloped insert disposed inside the secondary ice bin.

4. The refrigerator of claim 1, wherein the primary ice bin includes a variable volume reservoir that is positionable in a retracted position and an expanded position.

5. The refrigerator of claim 1, wherein the primary ice bin includes a variable volume reservoir that is positionable in a retracted position and an expanded position.

6. The refrigerator of claim 1, wherein a portion of the secondary ice bin is covered by a clear shelf.

7. A refrigerator comprising:

a cabinet including a cabinet door pivotally connected thereto;

an ice maker disposed inside the cabinet;

a primary ice bin disposed on one of the cabinet and the cabinet door and including a ramp pivotally coupled with the primary ice bin and operable between a raised position and a diverting position; and a secondary ice bin disposed on the other of the cabinet and the cabinet door, wherein the ramp does not interfere with dispensing of ice into the primary bin when in the raised position, and diverts ice from movement into the primary ice bin when in the diverting position and directs ice into the secondary ice bin.

8. The refrigerator of claim 7, wherein the secondary ice bin includes a dispersion slope integral with a bottom wall of the secondary ice bin.

9. The refrigerator of claim 7, further comprising:

a removable sloped insert disposed inside the secondary ice bin.

10. The refrigerator of claim 7, wherein the primary ice bin includes a variable volume reservoir that is positionable in a retracted position and an expanded position.

11. The refrigerator of claim 7, wherein the secondary ice bin includes an inner bin and an outer bin, the inner bin and the outer bin being separated by springs.

12. The refrigerator of claim 7, further comprising:

an ice storage bag that forms a portion of the secondary ice bin.

13. A refrigerator comprising:

a cabinet including a cabinet door pivotally connected thereto;

an ice maker disposed inside the cabinet;

a primary ice bin adapted to receive ice from the ice maker, wherein the primary ice bin is disposed on one of the cabinet and the cabinet door and operable between a receiving condition and an overflow condition;

a secondary ice bin disposed on the other of the cabinet and the cabinet door; and an overflow gate proximate the primary ice bin and operable between a closed position that corresponds to the receiving condition of the primary ice bin and an open position that corresponds to the overflow condition of the primary ice bin, wherein ice that is dispensed toward the primary ice bin from the ice maker flows over the overflow gate and into the secondary ice bin when the primary ice bin is in the overflow condition and the overflow gate is in the open position, thereby completely bypassing the primary ice bin.

14. The refrigerator of claim 13, wherein the gate is spring-biased to the closed position.

15. The refrigerator of claim 13, wherein the secondary ice bin includes a dispersion slope integral with a bottom wall of the secondary ice bin.

16. The refrigerator of claim 13, further comprising:

a sloped insert disposed inside the secondary ice bin.

17. The refrigerator of claim 13, further comprising:

a primary sensor disposed proximate the primary ice bin and a secondary sensor disposed proximate the secondary ice bin.

18. The refrigerator of claim 13, wherein the primary ice bin includes a variable volume reservoir that is positionable in a retracted position and an expanded position.

19. The refrigerator of claim 13, further comprising:

an ice storage bag that forms a portion of the secondary ice bin.

20. The refrigerator of claim 13, wherein the secondary ice bin includes a shelf supports that include hooks that latch into a rear shelf ladder of the appliance.

* * * * *